US011103113B2

(12) United States Patent
Schregardus et al.

(10) Patent No.: US 11,103,113 B2
(45) Date of Patent: Aug. 31, 2021

(54) BRUSH FOR AUTONOMOUS CLEANING ROBOT

(71) Applicant: iRobot Corporation, Bedford, MA (US)

(72) Inventors: Thomas P. Schregardus, Somerville, MA (US); Travis James Gschrey, Billerica, MA (US)

(73) Assignee: iRobot Corporation, Bedford, MA (US)

( * ) Notice: Subject to any disclaimer, the term of this patent is extended or adjusted under 35 U.S.C. 154(b) by 462 days.

(21) Appl. No.: 15/605,299

(22) Filed: May 25, 2017

(65) Prior Publication Data

US 2018/0338655 A1 Nov. 29, 2018

(51) Int. Cl.

| | |
|---|---|
| ***A47L 9/04*** | (2006.01) |
| ***A47L 9/00*** | (2006.01) |
| ***A47L 9/28*** | (2006.01) |

(52) U.S. Cl.

CPC ..... *A47L 9/0488* (2013.01); *A47L 9/009* (2013.01); *A47L 9/0411* (2013.01); (Continued)

(58) Field of Classification Search

CPC ..... A47L 9/0472; A47L 11/4038; A47L 2201/00; A47L 2201/04; A47L 2201/06; (Continued)

(56) References Cited

U.S. PATENT DOCUMENTS 5,903,951 A * 5/1999 Ionta ..... A46B 3/005 15/180
6,389,329 B1 5/2002 Colens
(Continued)

FOREIGN PATENT DOCUMENTS

CN 103799918 5/2014
CN 105686758 6/2016
(Continued)

OTHER PUBLICATIONS

"Mechanical Properties of Polymers." Accessed Jun. 10, 2019. SmithersRapra.com <https://www.smithersrapra.com/SmithersRapra/media/Sample-Chapters/Physical-Testing-of-Plastics.pdf>. pp. 1-4. (Year: 2019).*

(Continued)

*Primary Examiner* — Orlando E Aviles
*Assistant Examiner* — Joel D Crandall
(74) *Attorney, Agent, or Firm* — Fish & Richardson P.C.

(57) ABSTRACT

An autonomous cleaning robot includes a drive configured to move the robot across a floor surface, a brush proximate a lateral side of the robot, and a motor configured to rotate the brush about an axis of rotation. The brush includes a hub configured to engage the motor of the robot and arms each extending outwardly from the hub away from the axis of rotation and each being angled relative to a plane normal to the axis of rotation of the brush. Each of the arms include a first portion extending outwardly from the hub away from the axis of rotation and a second portion extending outwardly from the first portion away from the axis of rotation. An angle between the first portion of each of the arms and the plane is larger than an angle between the second portion of the each of the arms and the plane.

28 Claims, 13 Drawing Sheets

(52) U.S. Cl.
CPC ..... *A47L 9/0477* (2013.01); *A47L 9/2826* (2013.01); *A47L 9/2852* (2013.01); *A47L 2201/04* (2013.01); *A47L 2201/06* (2013.01)

(58) Field of Classification Search
CPC ..... A47L 9/0488; A47L 9/009; A47L 9/0411; A47L 9/0477; A47L 9/2826; A47L 9/2852
USPC ..... 15/320
See application file for complete search history.

(56) References Cited

U.S. PATENT DOCUMENTS

| | | | | |
|---|---|---|---|---|
| 6,532,404 | B2 | 3/2003 | Colens | |
| 6,594,844 | B2 | 7/2003 | Jones | |
| 6,690,134 | B1 | 2/2004 | Jones et al. | |
| 6,781,338 | B2 | 8/2004 | Jones et al. | |
| 6,809,490 | B2 | 10/2004 | Jones et al. | |
| 6,965,209 | B2 | 11/2005 | Jones et al. | |
| 7,155,308 | B2 | 12/2006 | Jones | |
| 7,173,391 | B2 | 2/2007 | Jones et al. | |
| 7,196,487 | B2 | 3/2007 | Jones et al. | |
| 7,388,343 | B2 | 6/2008 | Jones et al. | |
| 7,389,156 | B2 | 6/2008 | Ziegler et al. | |
| 7,448,113 | B2 | 11/2008 | Jones et al. | |
| 7,571,511 | B2 | 8/2009 | Jones et al. | |
| 7,636,982 | B2 | 12/2009 | Jones et al. | |
| 7,761,954 | B2 | 7/2010 | Ziegler | |
| 8,347,444 | B2 * | 1/2013 | Schnittman | A47L 11/34 15/41.1 |
| 8,869,342 | B2 * | 10/2014 | Yoon | A47L 11/24 15/319 |
| 9,414,734 | B2 | 8/2016 | Moon et al. | |
| 2002/0016649 | A1 | 2/2002 | Jones | |
| 2002/0120364 | A1 | 8/2002 | Colens | |
| 2003/0025472 | A1 | 2/2003 | Jones et al. | |
| 2004/0020000 | A1 | 2/2004 | Jones | |
| 2004/0049877 | A1 * | 3/2004 | Jones | A47L 5/30 15/319 |
| 2004/0187457 | A1 | 9/2004 | Colens | |
| 2004/0207355 | A1 | 10/2004 | Jones et al. | |
| 2005/0067994 | A1 | 3/2005 | Jones et al. | |
| 2005/0204717 | A1 | 9/2005 | Colens | |
| 2006/0272122 | A1 * | 12/2006 | Butler | A47L 9/0477 15/383 |
| 2007/0234492 | A1 | 10/2007 | Svendsen et al. | |
| 2007/0266508 | A1 | 11/2007 | Jones et al. | |
| 2008/0140255 | A1 | 6/2008 | Ziegler et al. | |
| 2008/0155768 | A1 | 7/2008 | Ziegler et al. | |
| 2008/0307590 | A1 | 12/2008 | Jones et al. | |
| 2010/0049365 | A1 | 2/2010 | Jones et al. | |
| 2010/0257690 | A1 | 10/2010 | Jones et al. | |
| 2010/0257691 | A1 | 10/2010 | Jones et al. | |
| 2010/0263158 | A1 | 10/2010 | Jones et al. | |
| 2012/0090133 | A1 | 4/2012 | Kim et al. | |
| 2013/0086760 | A1 * | 4/2013 | Han | A47L 11/4058 15/49.1 |
| 2013/0152332 | A1 * | 6/2013 | Jang | A47L 9/28 15/319 |
| 2013/0160226 | A1 | 6/2013 | Lee et al. | |
| 2014/0013767 | A1 | 1/2014 | Bohney et al. | |
| 2014/0067116 | A1 * | 3/2014 | Moon | A47L 11/4069 700/245 |
| 2014/0130294 | A1 * | 5/2014 | Li | A47L 9/0427 15/372 |
| 2014/0137367 | A1 | 5/2014 | Li et al. | |
| 2014/0150820 | A1 | 6/2014 | Yoo et al. | |
| 2016/0558256 | | 3/2016 | Ju | |
| 2016/0143496 | A1 * | 5/2016 | Penner | A47L 9/04 15/383 |
| 2016/0166127 | A1 * | 6/2016 | Lewis | A47L 9/02 15/49.1 |
| 2017/0354303 | A1 * | 12/2017 | Kastensson | A46B 13/008 |

FOREIGN PATENT DOCUMENTS

| | | | | |
|---|---|---|---|---|
| CN | 107072454 | | 8/2017 | |
| JP | 2014221149 | A * | 11/2014 | A46B 7/08 |
| JP | 2015091290 | A * | 5/2015 | |
| TW | M527298 | U | 8/2016 | |
| WO | WO-2016091320 | A1 * | 6/2016 | A46B 13/008 |

OTHER PUBLICATIONS

"Young's Modulus." Accessed Jun. 10, 2019. Wikipedia.com. <https://en.wikipedia.org/wiki/Young%27s_modulus>. pp. 6-7. (Year: 2019).*
International Search Report and Written Opinion in International Patent Application No. PCT/US2017/59075, dated Jan. 29, 2018, 5 pages.
"Facts on the Trilobite," Electrolux, accessed online <http://trilobite.electrolux.se/presskit_en/node1335.asp?print=yes&pressID=> Dec. 12, 2003, 2 pages.
"Welcome to the Electrolux Trilobite," Electrolux, accessed online <http://electroluxusa.com/node57.asp?currentURL=node142.asp%3F> Mar. 18, 2005, 2 pages.
Doty, K. L., and Harrison, R. R., Sweep Strategies for a Sensory-Driven, Behavior-Based Vacuum Cleaning Agent, AAAI 1993 Fall Symposium Series, Instantiating Real-World Agents, Research Triangle Park, Raleigh, NC, Oct. 22-24, 1993, pp. 1-6.
Everett, H.R. (1995). Sensors for Mobile Robots. AK Peters, Ltd., Wellesley, MA.
Hitachi: News release: The home cleaning robot of the autonomous movement type (experimental machine) is developed. May 29, 2003. Accessed online Mar. 18, 2005 <http://www.i4u.com/japanreleases/hitachirobot.htm> 5 pages.
Honda Motor Co., Ltd., English Translation of JP11212642, Aug. 9, 1999, 31 pages.
Jones, J., Roth, D. (Jan. 2, 2004). Robot Programming: A Practical Guide to Behavior-Based Robotics. McGraw-Hill Education TAB; 288 pages.
Karcher RC 3000 Robotic Cleaner, Product page, accessed online <http://www.karcher-usa.com/showproducts.php?op=view_prod&param1=143&param2=&param3=> Mar. 18, 2005, 3 pages.
Karcher RoboCleaner RC 3000, Dec. 12, 2003, 4 pages.
Karcher, Product Manual Download, 2003, 16 pages.
Neato botvac manual.
Prassler, et al., English Translation of DE19849978, Feb. 8, 2001, 16 pages.
Vorwerk (the one with the brush in corner) manual.
EP Extended European Search Report in European Appln. No. 17900281, dated Nov. 26, 2020, 7 pages.
PCT International Preliminary Report in International Appln. No. PCT/US2017/059075, dated Dec. 5, 2019, 5 pages.

* cited by examiner

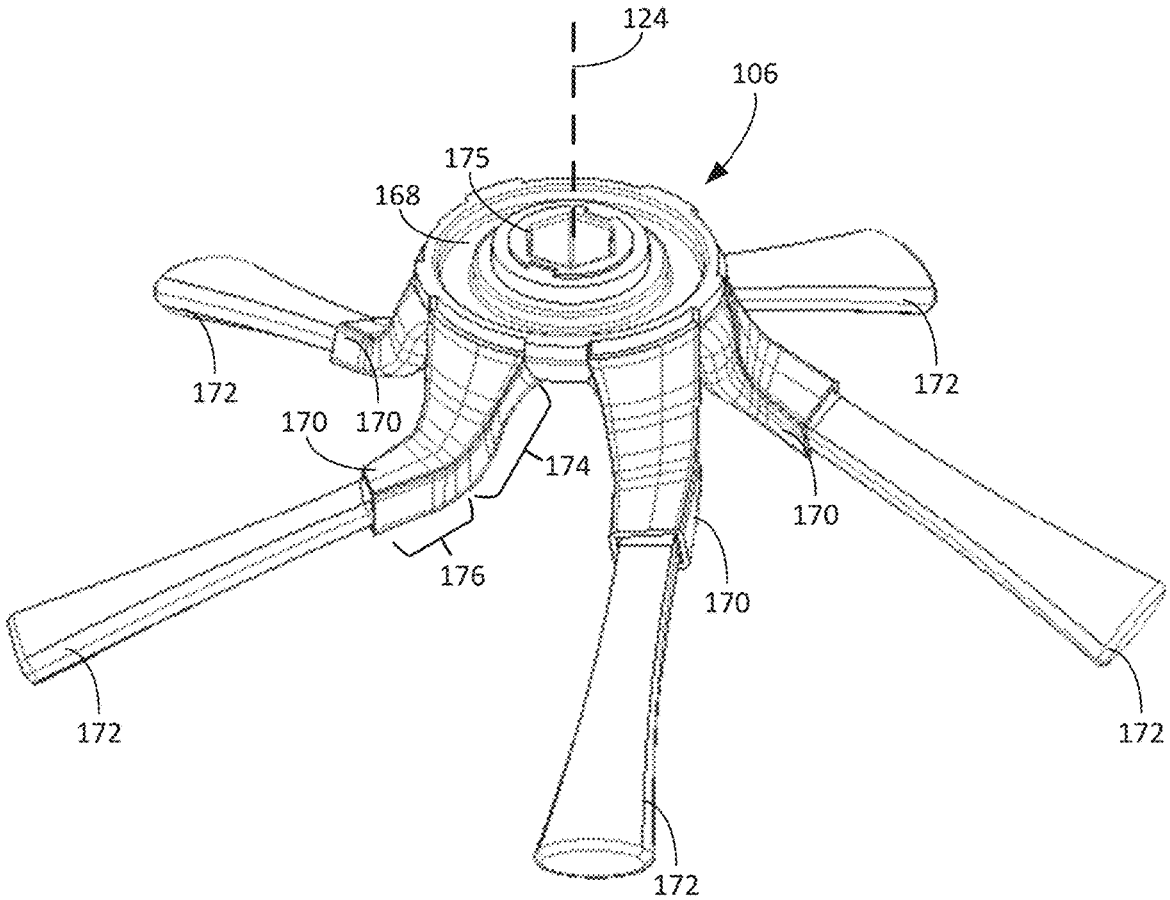
FIG. 6A
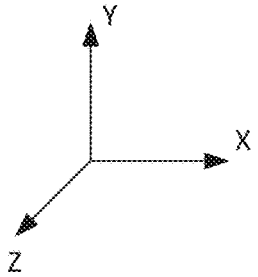

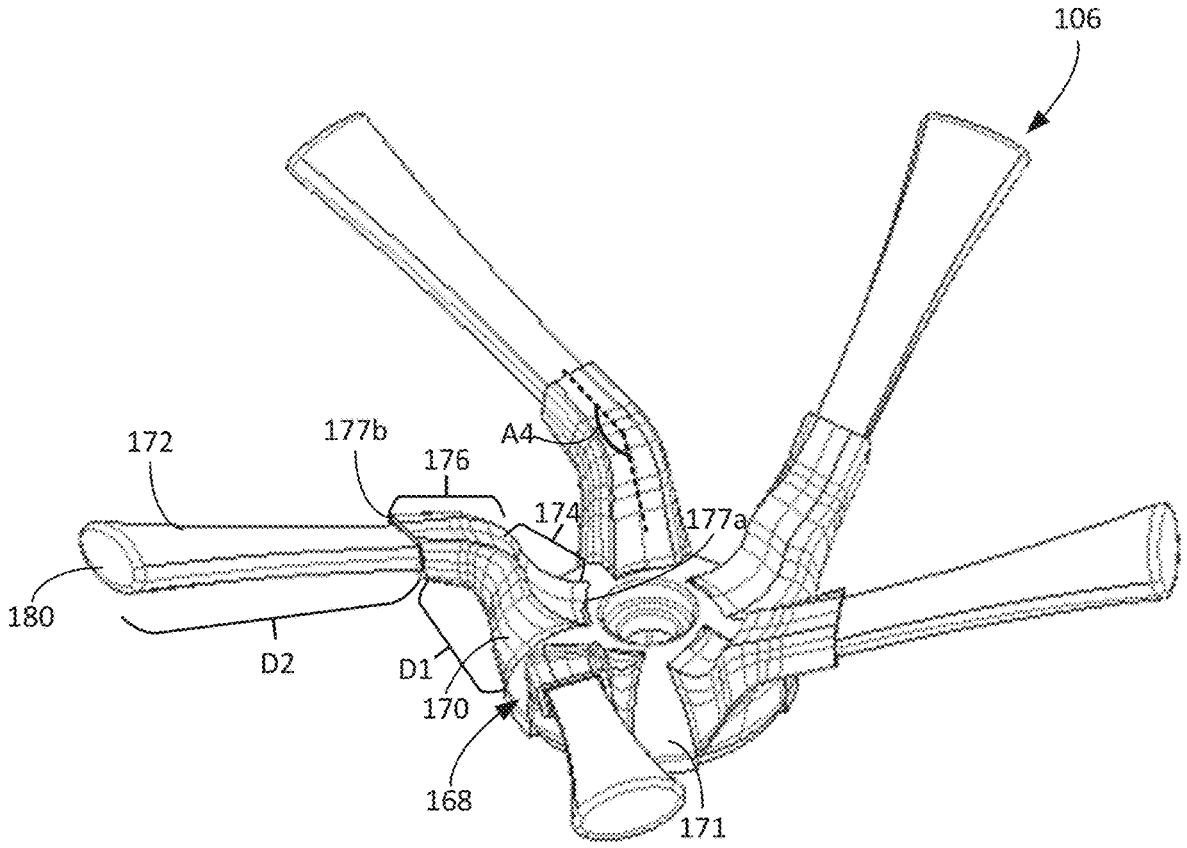
FIG. 6B
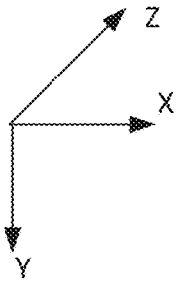

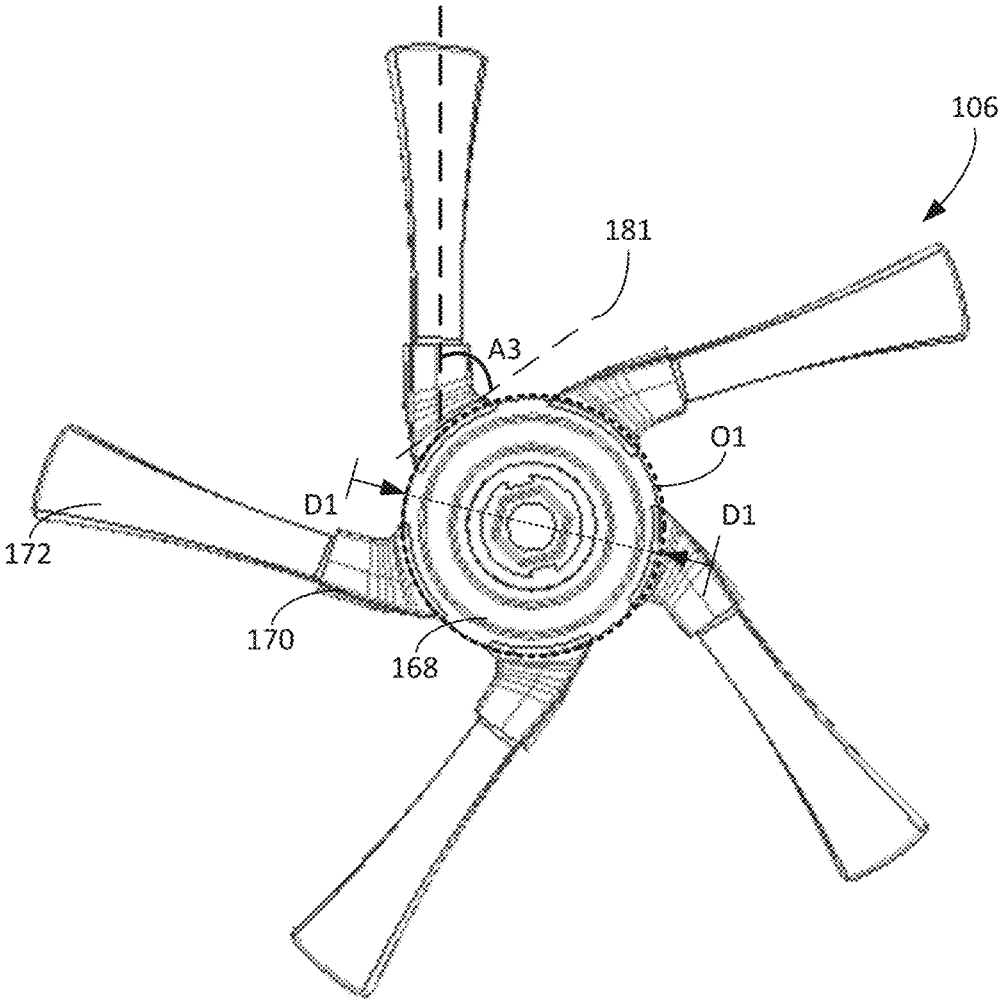
FIG. 6E
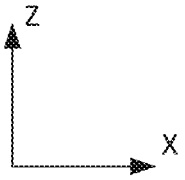

BRUSH FOR AUTONOMOUS CLEANING ROBOT

TECHNICAL FIELD

This specification relates to a brush for an autonomous cleaning robot.

BACKGROUND

An autonomous cleaning robot can navigate across a floor surface and avoid obstacles while vacuuming the floor surface to ingest debris from the floor surface. The robot can include a brush to agitate debris on the floor surface and collect the debris from the floor surface. For example, the brush can direct the debris toward a vacuum airflow generated by the robot, and the vacuum airflow can direct the debris into a bin of the robot.

SUMMARY

In one aspect, an autonomous cleaning robot includes a drive configured to move the robot across a floor surface, a brush proximate a lateral side of the robot, and a motor configured to rotate the brush about an axis of rotation. The brush includes a hub configured to engage the motor of the robot, arms each extending outwardly from the hub away from the axis of rotation and each being angled relative to a plane normal to the axis of rotation of the brush, and bristle bundles. Each of the arms include a first portion extending outwardly from the hub away from the axis of rotation and a second portion extending outwardly from the first portion away from the axis of rotation. An angle between the first portion of each of the arms and the plane is larger than an angle between the second portion of the each of the arms and the plane. Each of the bristle bundles is attached to a respective one of the arms and extends outwardly from the second portion of the respective arm.

In another aspect, a brush mountable to an autonomous cleaning robot includes a hub configured to engage a motor of the autonomous cleaning robot such that the brush rotates about an axis of rotation to agitate debris on a floor surface when the motor is driven, arms each extending outwardly from the hub away from the axis of rotation and each being angled relative to a plane normal to the axis of rotation of the brush, and bristle bundles. Each of the arms include a first portion extending outwardly from the hub away from the axis of rotation and a second portion extending outwardly from the first portion away from the axis of rotation. An angle between the first portion of each of the arms and the plane is larger than an angle between the second portion of the each of the arms and the plane. Each of the bristle bundles is attached to a respective one of the arms and extends outwardly from the second portion of the respective arm.

Implementations can include one or more of the features described below or herein elsewhere. In some implementations, the brush is a side brush. The robot can further include a main brush rotatable about an axis parallel to the floor surface. The side brush can be configured such that at least a portion of the bristle bundles of the side brush is positionable below the main brush during a portion of rotation.

In some implementations, the axis of rotation is substantially perpendicular to the floor surface.

In some implementations, the brush is a side brush. The robot can further include a front portion having a substantially rectangular shape, and a main brush disposed along the front portion of the robot. The main brush can extend across 60% to 90% of a width of the front portion of the robot. In some cases, the motor is configured to rotate the brush such that a distal end of each of the bristle bundles is swept through a circle defined by a diameter between 15% and 35% of the width of the front portion of the robot.

In some implementations, the brush is a side brush, and the robot further includes a cleaning head module including a main brush rotatable about an axis parallel to the floor surface. The side brush can be mounted proximate a corner portion of the cleaning head module.

In some implementations, the brush is positioned proximate a corner portion of the robot formed by a front surface of the robot and a lateral side of the robot. The motor can be configured to rotate the brush such that each of the bristle bundles is positionable beyond the front surface and the lateral side of the robot.

In some implementations, a top portion of the hub includes an inset portion to collect filament debris engaged by the brush. In some cases, the robot further includes a housing, and a bottom surface of the housing includes an inset portion configured to receive the inset portion of the hub. The hub can be configured to collect the filament debris in a region defined by the inset portion of housing and the inset portion of the hub. In some cases, the robot further includes an opening to receive the hub of the brush. The opening can be configured to collect filament debris received from the inset portion of the hub.

In some implementations, a height of the hub is between 0.25 cm and 1.5 cm.

In some implementations, the hub is formed from a rigid polymer material having an elastic modulus between 1 and 10 GPa, and the arms are formed from an elastomeric material having an elastic modulus between 0.01 and 0.1 GPa.

In some implementations, the angle between the first portion of each of the arms and the plane is between 70 and 90 degrees.

In some implementations, the angle between the second portion of each of the arms and the plane is between 15 and 60 degrees.

In some implementations, an angle between the first portion of each of the arms and the second portion of each of the arms is between 100 and 160 degrees.

In some implementations, the second portion of each of the arms is angled relative to the first portion of each of the arms away from a direction of rotation of the brush.

In some implementations, an angle between an axis along which the second portion extends and a circle defined by an outer perimeter of the hub is between 30 and 60 degrees.

Advantages of the foregoing may include, but are not limited to, those described below and herein elsewhere. For example, the relative angles of the different portions of the arms can enable the arms to extend toward the floor surface to engage the floor surface without being positioned in a manner that interferes with other components of the robot. The geometry of the arms can inhibit the rotating side brush from contacting other moving components of the robot, for example, other rotating brushes of the robot.

The brush can further include a feature that facilitates collection of filament debris engaged by the brush. Filament debris, including hair, threads, carpet fibers, etc., can be long thin strands that easily wrap around rotating members of autonomous cleaning robots, thereby impeding movement of these members. An inset portion of the brush can prevent the filament debris from wrapping around arms and bristle bundles of the brush and, instead, can facilitate collection of the filament debris within a predefined region. This predefined region can be located away from the arms and the bristles such that the filament debris does not impede the movement of the brush and does not impede sweeping operations of the brush.

In examples in which the robot includes a rotatable main brush and in which the brush is a side brush, the geometry of the arms enables the side brush to sweep a portion of the floor surface directly under the main brush without risking entanglement of the arms of the side brush with the main brush. In this regard, the main brush can extend across a larger portion of the width of the robot, thus providing the robot with a larger cleaning width compared to robots with side brushes that cannot easily sweep under main brushes.

The details of one or more implementations of the subject matter described in this specification are set forth in the accompanying drawings and the description below. Other potential features, aspects, and advantages will become apparent from the description, the drawings, and the claims.

BRIEF DESCRIPTION OF THE DRAWINGS

FIGS. 6A-6E are, respectively, top perspective, bottom perspective, side, bottom, and top views of a side brush.

Like reference numbers and designations in the various drawings indicate like elements.

DETAILED DESCRIPTION

Figure 1:
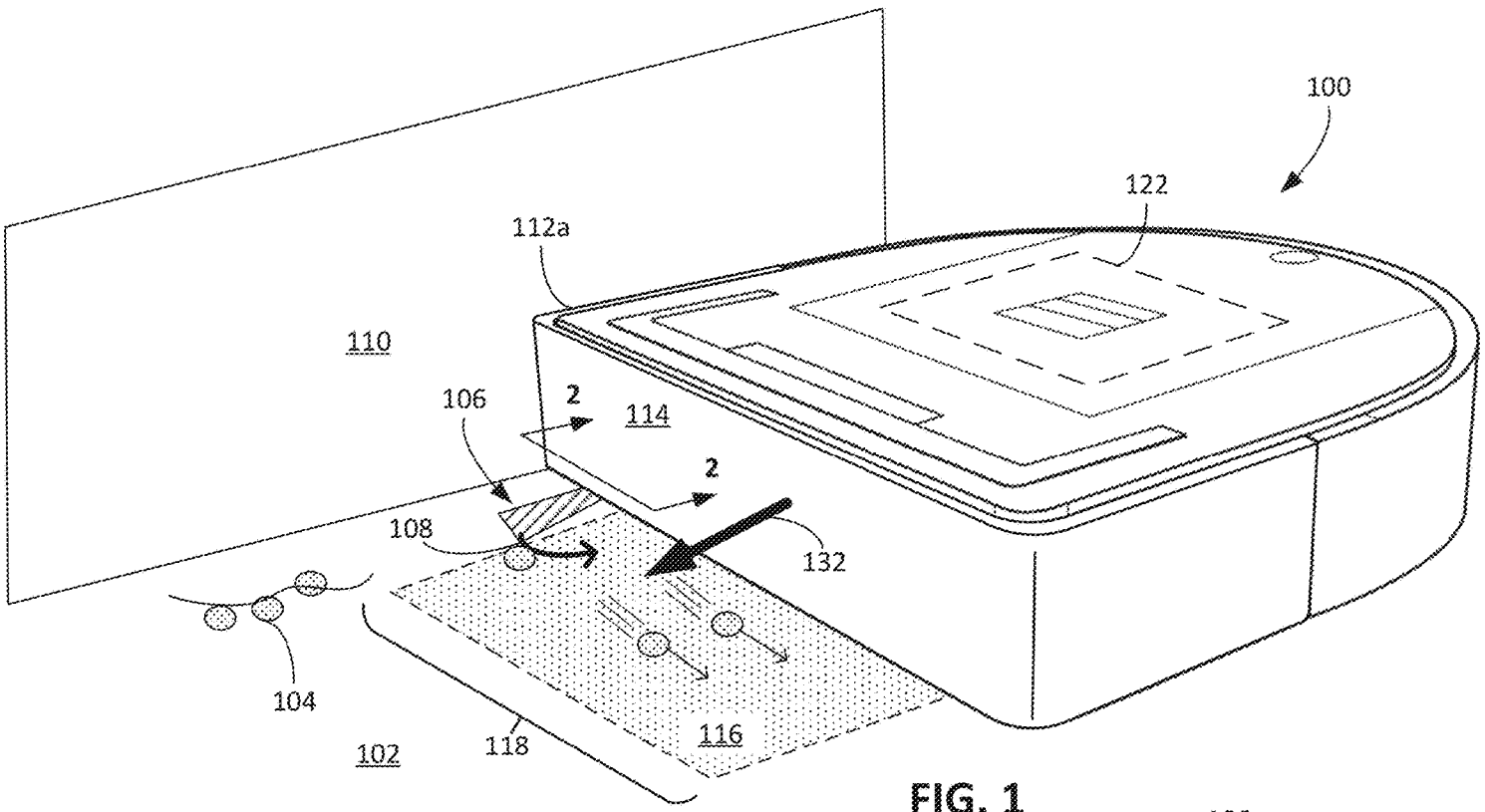
FIG. 1 is a perspective view illustrating an autonomous cleaning robot cleaning debris along an obstacle.

Referring to FIG. 1, an autonomous cleaning robot 100 performs an autonomous cleaning operation to in which the robot 100 autonomously moves about a floor surface 102 to clean the floor surface 102 by ingesting debris 104 located at different portions of the floor surface 102. A side brush 106 of the robot 100 that extends beyond an outer perimeter of the robot 100 and that is rotatable in a direction of rotation 108 (also shown in FIG. 2) to sweep debris 104 outside of the outer perimeter of the robot 100 toward a main brush 120*a* (shown in FIG. 2) on an underside of the robot 100. For example, the side brush 106 sweeps the debris toward a region in front of the robot 100 or otherwise into a projected cleaning path of the robot 100. During obstacle following behavior, the side brush 106 sweeps debris along an obstacle 110 as the robot 100 advances along a perimeter of the obstacle 110 and a lateral side 112*a* of the robot 100 tracks the obstacle 110. In the example of a robot having a rectangular front such as shown in FIG. 1, the side brush 106, located proximate the lateral side 112*a*, extends beyond the lateral side 112*a* of the robot 100 such that the side brush 106 can access debris 104 located along obstacles (e.g., walls, furniture, etc.) and at corners defined by obstacles. In some examples, the side brush 106 also extends beyond a forward surface 114 of the robot 100.

Figure 2:
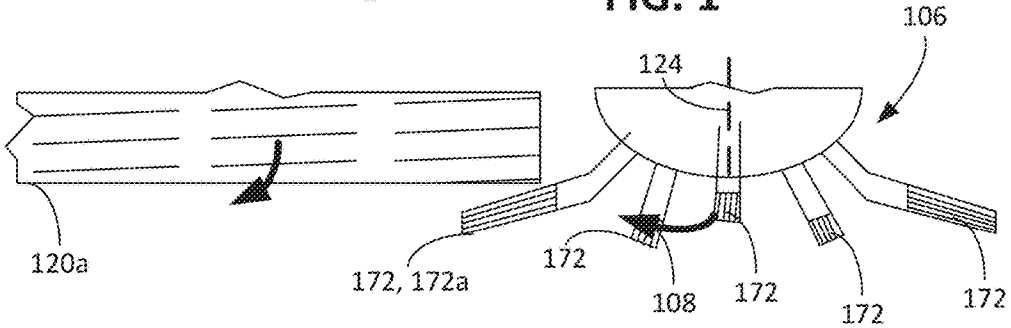
FIG. 2 is a side view, taken along the line 2-2 of FIG. 1, of a side brush and a main brush isolated from the robot of FIG. 1.

In the example depicted in FIG. 2, an arrangement of the side brush 106 relative to a main brush 120*a* of the robot 100 is shown. A width of the main brush 120*a* defines a cleaning width 118 (shown in FIG. 1) of the robot 100. During the autonomous cleaning operation, the main brush 120*a* is rotated to direct debris 104 under the robot 100 into a cleaning bin 122 (shown schematically in FIG. 1) of the robot 100, and the side brush 106 is rotated to propel debris 104 toward the main brush 120*a*. The side brush 106 enables the robot 100 to ingest debris 104 outside of the reach of the main brush 120*a* of the robot 100. For example, referring to FIG. 1, the side brush 106 sweeps debris 104 into a projected path 116 of the cleaning width 118 of the robot 100, e.g., a projected cleaning path of the robot 100. The projected path 116 corresponds to a region within which debris 104 on the floor surface 102 will be ingested by the robot 100, e.g., by a vacuum airflow, one or more rotating brushes, or a combination thereof.

As shown in FIG. 2, the side brush 106 is rotatable to sweep the floor surface 102 and propel debris toward the main brush 120*a*. The side brush 106 rotates about an axis of rotation 124 extending vertically away from the floor surface 102 and, in some examples, extending along an axis forming an angle less than 90 degrees with the floor surface 102. As described herein, geometry of the side brush 106 enables the side brush 106 to sweep a portion of the floor surface 102 below the main brush 120*a* while the main brush 120*a* rotates to ingest debris 104 from the floor surface 102. This allows the main brush 120*a* to extend along a greater portion of an overall width of the robot 100 without resulting in disruption of operations of the main brush 120*a* and the side brush 106 during the autonomous cleaning operation.

Example Autonomous Cleaning Robot

Figure 3:
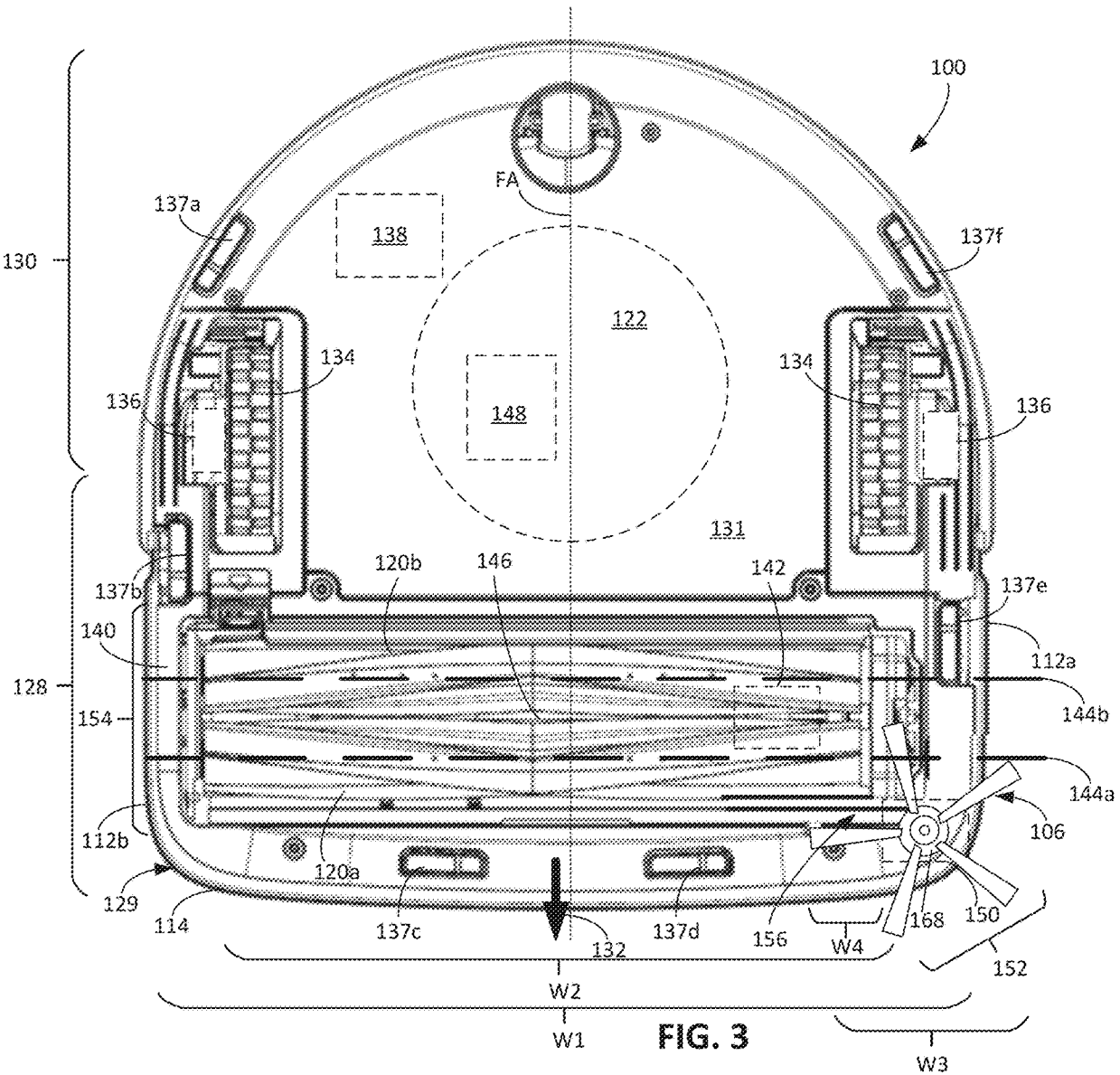
FIG. 3 is a bottom view of the robot of FIG. 1.

FIG. 3 depicts an example of the robot 100. The robot 100 includes a front portion 128 that has a substantially rectangular shape. For example, the front portion 128 includes a region of the robot 100 including a bumper 129 of the robot 100 and a portion of a body 131 of the robot 100. The forward surface 114 is substantially perpendicular to both of the lateral sides 112*a*, 112*b*, e.g., defines an angle between 85 degrees and 95 degrees with each of the lateral sides 112*a*, 112*b*. A rear portion 130 of the robot 100 has a substantially semicircular shape.

The robot 100 includes a drive system to move the robot 100 across a floor surface in a forward drive direction 132 (also shown in FIG. 1). The drive system includes drive wheels 134 driven by motors. Two motors 136 are schematically shown in FIG. 3, with each motor driving one of the drive wheels 134. The motors 136 are operatively connected to a controller 138 (schematically shown in FIG. 3) that is configured to operate the motors 136 to move the robot 100.

The controller 138 is configured to operate the robot 100 in multiple behaviors including a coverage behavior and an obstacle following behavior. For example, when the robot 100 performs an autonomous cleaning operation in a space having an interior portion and a perimeter enclosing the interior portion. The perimeter is defined by obstacles, e.g., furniture, wall surfaces, etc., in the space. During the autonomous cleaning operation, the robot 100 selects one of its behaviors to clean the floor surface of the space. In the coverage behavior, the robot 100 traverses the floor surface to clean the interior portion of the enclosed space. For example, the robot 100 moves back-and-forth across the space, turning in response to detection of the perimeter of the enclosed space, e.g., using obstacle detection sensors of the robot 100. In the obstacle following behavior, the robot 100 moves along a perimeter of an obstacle and hence the perimeter of the space to clean the perimeter.

As described herein, the robot 100 further includes the brush 120*a*. The robot 100 can have a single brush or can have multiple brushes as shown in FIG. 3. For example, the brush 120*a* is one of multiple brushes 120*a*, 120*b* exposed to the floor surface along a bottom surface 140 of the robot 100. The brushes 120*a*, 120*b* are driven to rotate by one or more motors to sweep debris on the floor surface. For example, in the example depicted in FIG. 3, a single motor 142 is operatively connected to the controller 138, which is configured to operate the motor 142 to drive both of the brushes 120*a*, 120*b*. The brushes 120*a*, 120*b* are configured to rotate about corresponding axes of rotation 144*a*, 144*b*, respectively. The axes of rotation 144*a*, 144*b* are parallel to the floor surface along which the robot 100 moves.

During the autonomous cleaning operation, the brushes 120*a*, 120*b* are driven to rotate in opposite directions such that each brush 120*a*, 120*b* draws debris toward an inlet 146 to a pathway to the cleaning bin 122. The inlet 146 can be a space between the brush 120*a* and the brush 120*b*. In some examples, the inlet 146 can be a space between the brush 120*a* or the brush 120*b* and a housing 188, e.g., to which the brushes 120*a*, 120*b* are mounted. For example, the robot 100 can include no more than one brush. The robot 100 includes a single brush, e.g., either the brush 120*a* or the brush 120*b*, and an inlet to the pathway to the cleaning bin 122 can be a space between the brush and the housing 188.

The robot 100 includes a vacuum system 148 operable by the controller 138 to generate an airflow from at least the inlet 146 through the pathway to the cleaning bin 122, thereby collecting debris proximate the inlet 146 in the cleaning bin 122. The vacuum system 148 generates a negative pressure to create the airflow that carries debris drawn into the pathway by the brushes 120*a*, 120*b*. The rotation of the brushes 120*a*, 120*b* directs debris on the floor surface toward the inlet 146 to enable the vacuum system 148 to carry the debris into the cleaning bin 122.

The brushes 120*a*, 120*b* are each disposed in the front portion 128 of the robot 100. This enables the widths of the brushes 120*a*, 120*b* to extend along a greater portion of a maximum width W1 of the robot and closer to the front of the robot 100, e.g., as compared to cases in which brushes are disposed in narrower portions of the semicircular rear portion 130 of the robot 100 or located near the center of the robot 100 near the wheels 134. While a diameter of the semicircular rear portion 130 of the robot 100 has the width W1, the front portion 128 has a width W1 through nearly its entire length, e.g., through at least 90% or more of the length of the front portion 128. In this regard, in some implementations, the brushes 120*a*, 120*b* are disposed only in the front portion 128 of the robot 100 so that the brushes 120*a*, 120*b* can extend across a greater portion of the width W1. In some examples, the width W1 corresponds to a width of the front portion 128. The width W1 is between, for example, 20 cm and 40 cm (e.g., between 20 cm and 30 cm, between 25 cm and 35 cm, between 30 cm and 40 cm, or about 30 cm.). The brushes 120*a*, 120*b* extend across a width W2 that is between, for example, 15 cm and 35 cm (e.g., between 15 cm and 25 cm, between 20 cm and 30 cm, between 25 cm and 35 cm, or about 25 cm). The width W2 is 60% to 90% of the width W1 of the robot 100 (e.g., between 60% and 80%, between 65% and 85%, between 70% and 90%, between 75% and 90%, between 80% and 90%, or about 75% of the width W1).

As described herein, the robot 100 further includes the side brush 106 (also referred to as a corner brush when placed in a corner), which is rotatable to sweep debris toward the brushes 120*a*, 120*b* of the robot 100. The side brush 106 thus cooperates with the brushes 120*a*, 120*b* and the vacuum system 148 to collect debris from the floor surface in the cleaning bin 122.

The side brush 106 extends outwardly away from the robot 100 and away from the bottom surface 140 of the robot 100. The side brush 106 is mounted to a motor 150 of the robot 100, the motor 150 being operatively connected to the controller 138. The controller 138 is configured to operate the motor 150 to rotate the side brush 106, which sweeps debris on a floor surface toward the brushes 120*a*, 120*b*. The side brush 106 extends across a width W3 between 2 cm and 12 cm (e.g., between 2 cm and 12 cm, between 2 cm and 4 cm, between 4 cm and 12 cm, between 6 cm and 10 cm, between 7 cm and 9 cm, about 3 cm, or about 8 cm). The width W3 is between 15% and 35% of the width W1 of the robot 100 (e.g., between 15% and 25%, between 20% and 30%, between 25% and 35%, or about 25% of the width W1). The width W3 is between 5% and 40% of the width W2 of the brushes 120*a*, 120*b* (e.g., between 5% and 15%, between 10% and 20%, between 20% and 30%, between 25% and 35%, between 30% and 40%, about 10%, or about 30% of the width W1). A width W4 corresponding to a portion of the width W2 of the brushes 120*a*, 120*b* that overlaps the width W3 of the side brush 106 is between, for example, 0.5 cm and 5 cm (e.g., between 0.5 and 1.5 cm, between 1.5 cm and 4 cm, between 2 cm and 4.5 cm, between 2.5 cm and 5 cm, about 1 cm, or about 2.5 cm).

The side brush 106 is located proximate one of the lateral sides 112*a*, 112*b* of the robot 100. In the example depicted in FIG. 3, the side brush 106 is located proximate the lateral side 112*a* such that at least a portion of the side brush 106 extends beyond the lateral side 112*a* during rotation of the side brush 106. A center of the side brush 106 is mounted between 1 cm and 5 cm from the lateral side 112*a* (e.g., between 1 and 3 cm, between 2 and 4 cm, between 3 and 5 cm, or about 3 cm from the lateral side 112*a*). The side brush 106 extends beyond the lateral side 112*a* by between 0.25 cm and 2 cm (e.g., at least 0.25 cm, at least 0.5 cm, at least 0.75 cm, between 0.25 cm and 1.25 cm, between 0.5 cm cm and 1.5 cm, between 0.75 cm and 1.75 cm, between 1 cm and 2 cm, or about 1 cm).

The side brush 106 is also located proximate the forward surface 114 such that at least a portion the side brush 106 extends beyond the forward surface 114 of the robot 100 during rotation of the side brush 106. In some examples, the center of the side brush 106 is mounted between 1 and 5 cm from the forward surface 114 (e.g., between 1 and 3 cm, between 2 and 4 cm, between 3 and 5 cm, or about 3 from the forward surface 114). The side brush 106 extends beyond the forward surface 114 by between 0.25 cm and 2 cm (e.g., at least 0.25 cm, at least 0.5 cm, at least 0.75 cm, between 0.25 cm and 1.25 cm, between 0.5 cm and 1.5 cm, between 0.75 cm and 1.75 cm, between 1 cm and 2 cm, about 1 cm, or about 0.75 cm.).

By being proximate the lateral side 112*a* and the forward surface 114, the side brush 106 is thus located proximate a corner portion 152 of the robot 100, the corner portion 152 being defined by the lateral side 112*a* and the forward surface 114. In some cases, the corner portion 152 includes a rounded portion connected by the lateral side 112*a* and the forward surface 114, with a segment of the corner portion 152 defined by the lateral side 112*a* and a segment of the forward surface 114 forming substantially a right angle. The corner portion 152 can fit into corresponding corner geometries found in a home, e.g., defined by obstacles. For example, the corner portion 152 can fit into corresponding right-angled geometries defined by obstacles in the home.

By being positioned such that at least a portion of the side brush 106 extends beyond both the forward surface 114 and the lateral side 112*a*, the side brush 106 can easily access and contact debris on a floor surface outside of a region directly beneath the robot 100. For example, the side brush 106 can access debris outside of the projected path 116 (shown in FIG. 1) of the brushes 120*a*, 120*b* such that the side brush 106 can contact the debris and propel the debris into the projected path of the brushes 120*a*, 120*b*. As the robot 100 travels along the floor surface, the side brush 106 can enable the robot 100 to collect debris forward of the forward surface 114 and adjacent to the lateral side 112*a*. Furthermore, the side brush 106 can sweep debris adjacent to the corner geometries toward the brushes 120*a*, 120*b* so that the brushes 120*a*, 120*b* can ingest the debris. In some cases, the side brush 106 extends forward of a forwardmost point of the forward surface 114 of the robot 100. In such examples, the side brush 106 can engage debris adjacent to an obstacle forward of the robot 100.

In some examples, the robot 100 includes a cleaning head module 154 that includes the brushes 120*a*, 120*b*. The cleaning head module 154 further includes the one or more motors to drive the brushes 120*a*, 120*b*. In some implementations, the cleaning head module 154 further includes the side brush 106 (shown in FIG. 3) and the one or more motors to drive the side brush 106. The side brush 106 is mounted proximate a corner portion 156 of the cleaning head module 154. For example, the side brush 106 is mounted between 0.5 cm and 2.5 cm from the corner portion 156 (e.g., between 0.5 cm and 1.5 cm, between 1 cm and 2 cm, between 1.5 cm and 2.5 cm, about 1.5 cm). The cleaning head module 154, including the housing 188, the brush or brushes 120*a*, 120*b*, motor(s), and the side brush 106, can be removed as a complete unit and replaced if needed.

Figure 4:
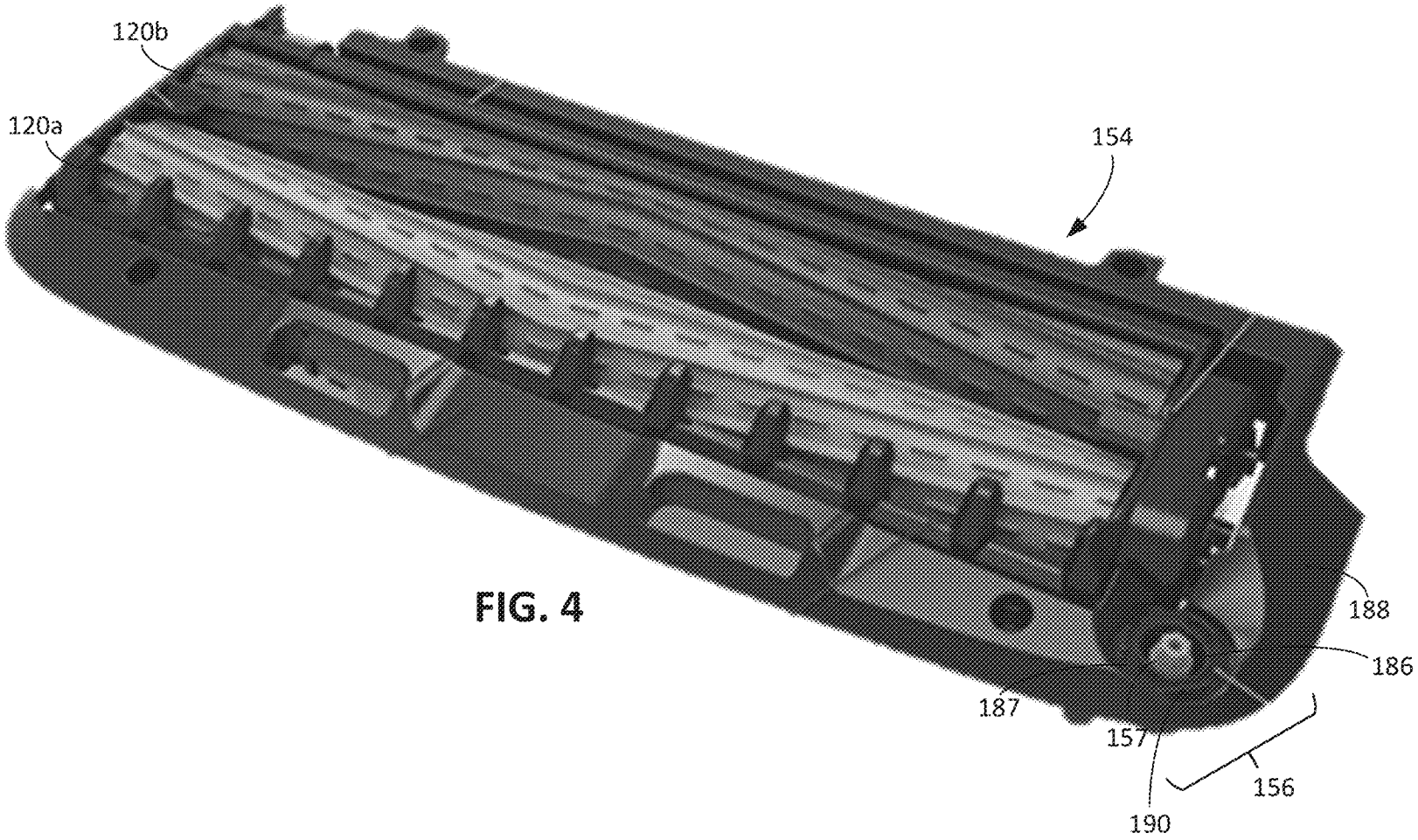
FIG. 4 is a bottom perspective view of a cleaning head module of the robot of FIG. 3.

The side brush 106 is mountable to a drive shaft 157 connected to the motor 150 that drives the side brush 106. As depicted in FIG. 4, the side brush 106 is removable from the cleaning head module 154 and thus dismountable from the drive shaft 157.

The cleaning head module 154 is mountable, as a unit, to the rest of the robot 100 and is also dismountable, as a unit, from the rest of the robot 100. In some cases, the cleaning head module 154 is mounted at least partially within the body 131 (shown in FIG. 3) of the robot 100. This can make maintenance of the cleaning head module 154 easier to perform. For example, the cleaning head module 154, including its brushes 120*a*, 120*b*, can be easily replaced by a new cleaning head module with new brushes. In addition, the cleaning head module 154 can be movable relative to the chassis of the robot 100 such that the cleaning head module 154 can move in response to contact with obstacles along the floor surface over which the robot 100 moves or in response to a change in flooring type. If the side brush 106 is disposed on the cleaning head module 154, contact between the side brush 106 and obstacles on the floor surface can also cause the cleaning head module 154 to move. This can prevent damage to the brushes 120*a*, 120*b*, the side brush 106, and the cleaning head module 154.

Figure 5B:
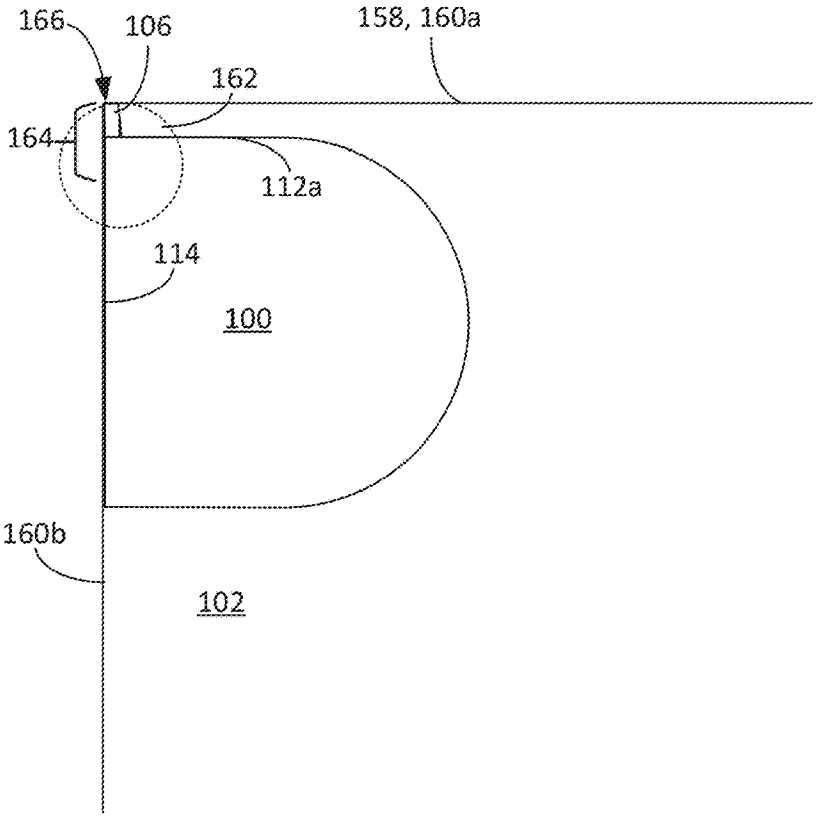
FIGS. 5A and 5B are top views of the robot of FIG. 3 performing an obstacle following behavior.
Figure 5A:
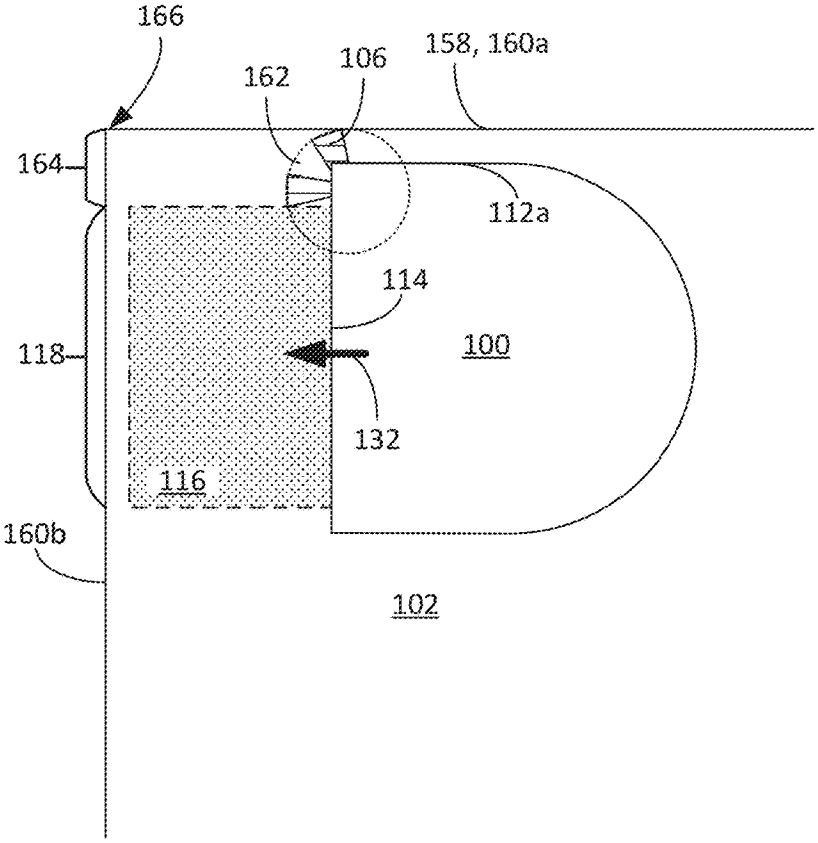

Referring to FIGS. 5A and 5B, during the obstacle following behavior, the robot 100 travels adjacent a perimeter 158 of an obstacle 160*a* such that the lateral side 112*a* is positioned adjacent the perimeter 158. By being positioned proximate the lateral side 112*a*, the side brush 106 is positioned to reach debris along the perimeter 158 of the obstacle 160*a* during the obstacle following behavior. For example, the lateral side 112*a* corresponds to a dominant obstacle-following side of the robot 100 such that the controller 138 (shown in FIG. 3) repositions the robot 100 so that the lateral side is adjacent to the followed object or wall.

As shown in FIG. 3, the robot 100 includes multiple cliff sensors 137*a*-137*f*. The cliff sensors 137*a*-137*f* are configured to provide a signal when a floor surface does not occupy the region below one or more of the cliff sensors 137*a*-137*f*. For example, the cliff sensors 137*a*-137*f* can be infrared emitter and receiver pairs having overlapping fields of view configured to identify when a floor surface is present beneath the cliff sensors 137*a*-137*f* and redirect the robot 100 when the floor surface is not present (e.g., redirect the robot 100 away from a cliff such as a stair).

In the example of FIG. 3, the side brush 106 is located in the corner portion 152. The location of the side brush 106 and its associated motor causes the brushes 120*a*, 120*b* to be offset from the center of the robot. For example, the brushes 120*a*, 120*b* are located closer to the lateral side 112*b* than the lateral side 112*a* by 0.5 cm to 2.5 cm (e.g., by 0.5 to 1.5 cm, 1 cm to 2 cm, 1.5 cm to 2.5 cm, or about 1 cm). Additionally, by locating the brushes 120*a*, 120*b* close to the lateral side 112*b* (e.g., within about 3 cm), the cliff sensor 137*b* located on the lateral side 112*b* is placed behind the brushes 120*a*, 120*b* (e.g., behind the brushes and ahead of the wheel 134) while the cliff sensor 137*e* is located proximate the brushes 120. Thus, the side cliff sensors 137*b* and 137*e* are not symmetrically located about a fore-aft axis FA of the robot 100. The robot 100 also includes four additional cliff sensors 137*a*, 137*c*, 137*d*, and 137*f*. Two cliff sensors 137*c* and 137*d* are located proximate a front surface 114 ahead of the brushes 120*a*, 120*b* and two cliff sensors 137*a* and 137*f* located rear of the wheels 134. The forward cliff sensors 137*c*, 137*d* and rear cliff sensors 137*a*, 137*f* can be symmetrically located about the fore-aft axis FA.

The side brush 106 is rotatable through a cleaning area 162. Because the side brush 106 extends beyond the lateral side 112*a* and the forward surface 114, the cleaning area 162 extends beyond the lateral side 112*a* and the forward surface 114. As a result, the side brush 106 is configured to engage debris within the cleaning area 162 on the floor surface 102 so that the debris can be swept toward the projected path 116 of the cleaning width 118 of the robot 100. For example, the side brush 106 cooperates with the brushes 120*a*, 120*b* and the vacuum system 148 to collect, within the cleaning bin 122 (shown in FIG. 3), debris beyond a perimeter of the robot 100. The cleaning width 118 does not extend into a portion 164 of the floor surface 102 adjacent the perimeter 158 of the obstacle 160*a*. At least some of the portion 164 is located under the robot 100 because the projected path 116 does not extend the entire width W1 of the robot 100. In this regard, the brushes 120*a*, 120*b* and the vacuum system 148 of the robot 100 (shown in FIG. 3) cannot collect debris within the portion 164 of the floor surface 102 unless this debris is moved into the projected path 116. The side brush 106, when rotated, can facilitate this movement of the debris. For example, the side brush 106 reaches debris within the cleaning area 162 and thus sweeps the debris in the portion 164 toward the projected path 116, thereby enabling the robot 100 to collect debris located within the portion 164.

Furthermore, as shown in FIG. 5B, because the side brush 106 extends beyond both the forward surface 114 and the lateral side 112*a*, the side brush 106 is configured to extend into a corner 166 defined by the intersection of the obstacles 160*a*, 160*b*. The corner 166 can be difficult to clean for the robot 100 due to the geometry of the outer perimeter of the robot 100 and due to the positioning of the brushes 120*a*, 120*b* within the outer perimeter. The side brush 106 extends beyond the outer perimeter to enable debris to be collected from the corner 166 and other complex obstacle perimeter geometries, e.g., curves, crevasses, etc.

Example Side Brush

FIGS. 6A-6E depict an example of the side brush 106. This example is described with respect to the X-axis, the Y-axis, and the Z-axis. The axis of rotation 124 of the side brush 106 is parallel to the Y-axis. As described herein, in some cases, the Y-axis is parallel to a vertical axis extending perpendicularly from the floor surface, while in other implementations, the Y-axis and the vertical axis form a non-zero angle.

Referring to FIG. 6A, the side brush 106 includes a hub 168, arms 170, and bristle bundles 172. The side brush 106 is axisymmetric about the axis of rotation 124. The side brush 106 is mounted such that it can sweep a portion of the floor surface under the robot 100 to propel debris on the floor surface toward the brushes 120*a*, 120*b* as the side brush 106 rotates about the axis of rotation 124. The portion of the floor surface swept by the side brush further includes a portion directly beneath at least one of the brushes 120*a*, 120*b*. As described herein, the hub 168, the arms 170, and the bristle bundles 172 are configured such that the side brush 106 can sweep under the brushes 120*a*, 120*b* without interfering with operation of the brushes 120*a*, 120*b*.

Referring to FIG. 6B, the hub 168 includes a semispherical body 171 having a circular cross-section, e.g., along a plane perpendicular to the axis of rotation 124. In some examples, a circle O1 (shown in FIG. 6E) is defined by an outer perimeter of the hub 168 as viewed along the Y-axis. The circle O1 has a diameter D1 (shown in FIG. 6E) between 1 cm and 3 cm (e.g., between 1 cm and 2 cm, between 1.5 cm and 2.5 cm, between 2 cm and 3 cm, or about 2 cm).

The hub 168 is configured to engage a side brush motor (e.g., the motor 150) of the robot 100 (shown in FIG. 3). For example, as shown in FIG. 6A, the hub 168 includes a bore 175 sized and dimensioned to engage the drive shaft 157 (shown in FIG. 4). The bore 175, when engaged to the drive shaft 157, enables transfer of torque from the side brush motor to the hub 168 such that the side brush motor can rotate the side brush 106. In some cases, at least a portion of the hub 168 is positioned above the bottom surface 140 of the robot 100 (shown in FIG. 3).

A height H1 (shown in FIG. 6C) of the hub 168 is between 0.25 cm and 1.5 cm (e.g., between 0.25 cm and 1 cm, 0.5 cm and 1.25 cm, 0.75 and 1.5 cm, or about 0.75 cm). For example, the height H1 is defined by the lowest point at which the arms 170 is attached to the hub 168 and the topmost surface of the bore 175. Because the hub 168 is a rigid plastic component, an impact force on the hub 168 can transfer to the drive shaft 157 without substantial attenuation. As a result, the impact force on the hub 168 can damage the drive shaft 157. The height H1 is relatively small so that the hub 168 is less likely to contact obstacles along the floor surface. The relatively small height of the hub 168 can thus prevent damage to the drive shaft 157 or the side brush motor. As described herein, the hub 168 can be part of the cleaning head module 154. As a result, impact on the hub 168 can cause the cleaning head module 154 as a unit to move, thereby dampening the force of the impact and preventing damage to the side brush 106 due to the impact.

The hub 168, the arms 170, and the bristle bundles 172 can be formed of different materials. For example, the hub 168 is a monolithic plastic component from which the arms 170, the bristle bundles 172, or both extend. The hub 168 is formed from a rigid polymer material having an elastic modulus between 1 and 10 GPa, and the arms 170 are formed from an elastomeric material having an elastic modulus between 0.01 and 0.1. For example, the hub 168 is formed from polycarbonate or acrylonitrile butadiene styrene, and the arm 170 is formed from an elastomer. The arms 170 are thus more easily deformable than the hub 168. The arms 170 serve as a protective sheath for the bristle bundles 172 that keep bristles of each of the bristle bundles 172 together while also being deformable such that the bristle bundles 172 and the arms 170 can deform together in response to contact with the floor surface and obstacles on the floor surface. As a result, the arms 170 can prevent the bristle bundles 172 from being damaged.

Figure 6C:
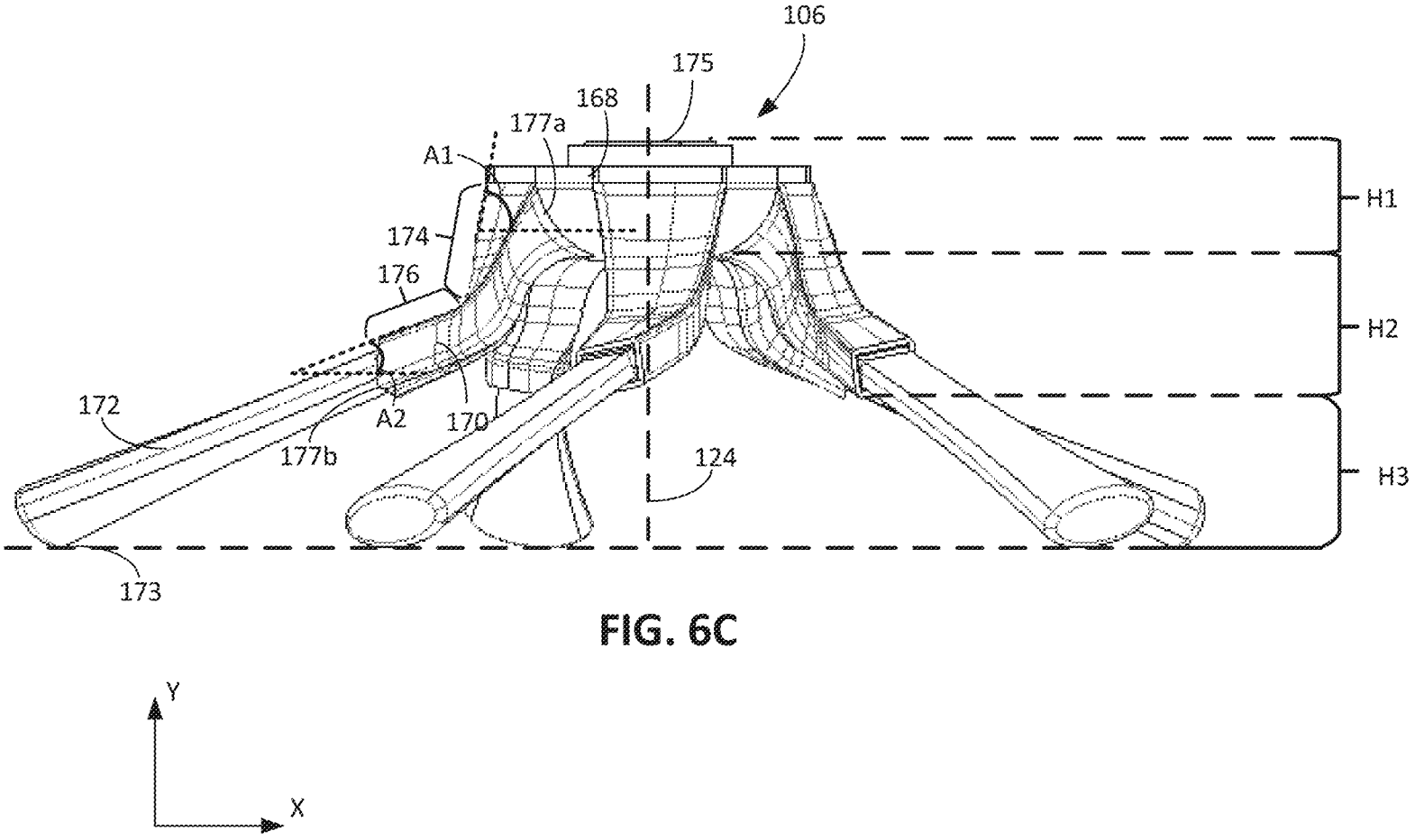

Referring to FIG. 6C, the arms 170 extend outwardly from the hub 168 away from the axis of rotation 124 of the side brush 106. The arms 170 each extends along a length L1 (shown in FIG. 6D) between 0.5 cm and 2.5 cm (e.g., between 0.5 cm and 1.5 cm, between 1 cm and 2 cm, between 1.5 cm and 2.5 cm, or about 1.5 cm.). The length L1 corresponds to a straight line length from a proximal end 177*a* to a distal end 177*b* of each arm 170, with the proximal end 177*a* being attached to the hub 168.

Each of the arms 170 is angled relative to a plane 173 normal to the axis of rotation 124 of the brush 106. The arms 170 are formed of two portions 174, 176 that are angled differently with respect to the plane 173. The differently angles portions 174, 176 allow the arm 170 both to span a vertical distance between the robot 100 and the floor surface and form a desired swept circle for the bristle bundles 172. For example, a slope of the portion 174 of the arms 170 (relative to the plane 173) closest to the hub 168 is greater than a slope of the portion 176 of the arms 170 (relative to the plane 173) further from the hub 168.

The first portion 174 and the second portion 176 each extends downwardly toward a floor surface when the side brush 106 is mounted to the drive shaft 157. In this regard, while the height H1 of the hub 168 may be small so that the hub 168 is positioned above the floor surface by a clearance height, the first portion 174 and the second portion 176 extend downwardly to enable the bristle bundles 172 to contact the floor surface.

The first portion 174 and the second portion 176 also each extends outwardly from the hub 168, e.g., in a direction along the plane 173. The first portion 174 is attached to the hub 168 at the proximal end 177*a* of each arm 170 and extends outwardly from the hub 168 away from the axis of rotation 124. The second portion 176 extends outwardly from the first portion 174 away from the axis of rotation 124 and terminates at the distal end 177*b* of each arm 170. For example, referring to FIG. 6D, the first portion 174 and the second portion 176 both extend outwardly away from the axis of rotation 124 such that the distal end 177*b* of each arm 170 is swept through a circle O2 when the side brush 106 is rotated about the axis of rotation 124. The circle O2 corresponds to a circle swept by an outer point of the distal end 177*b* of each arm 170 when viewed along the Y-axis. The circle O2 has a diameter D2 between 2 cm and 4 cm (e.g., between 2 cm and 3 cm, between 2.5 cm and 3.5 cm, between 3 cm and 4 cm, or about 3 cm). By each extending outwardly away from the axis of rotation 124, the first portion 174 and the second portion 176 allow the side brush 106 to extend outwardly from the robot 100, e.g., to extend and cover an area beyond the outer perimeter of the robot 100 and to cover an area outside of the cleaning width of the robot 100 and beneath the robot 100.

Referring back to FIG. 6C, the first portion 174 extends downwardly from the hub 168. In some examples, the second portion 176 also extends downwardly from the first portion 174. By extending downwardly from the hub 168, the arms 170 enable the bristle bundles 172 to be positionable to contact the portion of the floor surface below the side brush 106. For example, a height H2 of each arm 170 between the proximal end 177*a* (e.g., a lowermost point of the proximal end 177*a*) and the distal end 177*b* (e.g., a lowermost point of the distal end 177*b*) is between 0.25 and 1.5 cm (e.g., between 0.25 cm and 1 cm, 0.5 cm and 1.25 cm, 0.75 cm and 1.5 cm, or about 0.8 cm).

In some examples, an angle A1 between the first portion 174 of each of the arms 170 and the plane 173 is larger than an angle A2 between the second portion of the each of the arms and the plane 173. The angle A1 and the angle A2 correspond to angles as measured within the X-Y plane when the axis along which the second portion 176 extends parallel to the X-axis. The first portion 174 of each of the arms 170 is angled upward relative to the second portion 176 such that the first portion 174 has a shallower angle relative to the plane 173 than the steeper angle of the second portion 176 relative to the plane 173. The angle A1 is between 70 and 90 degrees (e.g., between 70 and 80 degrees, between 75 degrees and 85 degrees, between 80 degrees and 90 degrees, or about 80 degrees). The angle A2 is between 0 and 60 degrees (e.g., between 15 and 60 degrees, between 15 and 45 degrees, between 15 and 30 degrees, or about 30 degrees).

The second portion 176 of each of the arms 170 is angled relative to the first portion 174 in a direction opposite the direction of rotation 108 of the side brush 106. For example, referring to FIG. 6E, each of the arms 170 extends from a portion of the hub 168 along the circle O1. An angle A3 corresponds to an angle between (i) an axis along the X-Z plane and along which the second portion 176 of an arm 170 extends and (ii) a line 181 tangent to the circle O1 and extending through the point at which the axis of the second portion 176 intersects the circle O1. The angle A3 is between, for example, 30 and 60 degrees (e.g., between 30 and 50 degrees, 35 and 55 degrees, 40 and 60 degrees, etc.). In some cases, the first portion 174 of each of the arms 170 extends along a radial axis and thus is substantially perpendicular to the tangent line 181. This angle of the second portion 176 relative to the tangent line 181 can reduce stress concentrations along the arms 170 when the arms 170 deflect during rotation of the side brush 106.

In some implementations, referring back to FIG. 6B, an angle A4 between the first portion 174 of each of the arms 170 and the second portion 176 of each of the arms 170 is between 100 and 160 degrees (e.g., between 100 and 140 degrees, between 110 and 150 degrees, between 120 and 160 degrees, or about 130 degrees). The bristle bundles 172 each includes multiple bristles that sweep the floor surface as the side brush 106 is rotated during the autonomous cleaning operation. Referring back to FIG. 2, the bristle bundles 172 of the side brush 106 can sweep the floor surface 102 and propel debris toward the main brush 120*a*. Each of the bristle bundles 172 is repositioned as the side brush 106 is rotated. For example, at least a portion of the bristle bundles 172, e.g., the bristle bundle 172*a*, as shown in FIG. 2, is positionable below the main brush 120*a* during a portion of the rotation of the side brush 106 and during rotation of the main brush 120*a*.

In the example depicted in FIGS. 6A-6E, the bristle bundles 172 extend from the arms 170 along an axis at a non-zero angle relative to an axis perpendicular to the axis of rotation 124, e.g., an axis extending through a radius of any of the concentric circles O1, O2, or O3. In some implementations, each of the bristle bundles 172 extend parallel to the perpendicular axis.

The bristle bundles 172 each includes multiple deflectable fibers assembled in a bundle. Referring to FIG. 6B, each of the bristle bundles 172 extends from a corresponding second portion 176 of the arms 170, each bristle bundle 172 terminating at a corresponding distal end 180. The bristle bundles 172 extend from the arms 170 along axes parallel to the axes along which the second portions 176 of the arms 170 extend. A length L2 of the bristle bundles 172 beyond the arms 170 (shown in FIGS. 6B and 6D) is between 1 cm and 5 cm (e.g., between 1 cm and 4 cm, between 1.5 cm and 4.5 cm, between 2 cm and 5 cm, about 2.5 cm, or about 3 cm.). The length L2 corresponds to a straight line length from the distal end 177*b* of each arm 170 to the distal end 180 of each bristle bundle 172. The length L2 is 40% and 80% of the length L1 of the arms 170 (e.g., between 40% and 60%, between 50% and 70%, between 60% and 80%, about 50%, about 60%, or about 70% of the length L1 of the arms 170). A height H3 of each bristle bundle 172 between the distal end 177*b* of each arm 170 (e.g., a lowermost point of the distal end 177*b*) and the distal end 180 of each bristle bundle 172 is between 0.25 and 2 cm (e.g., between 0.25 cm and 1.5 cm, between 0.5 cm and 1.75 cm, between 0.75 cm and 2, or about 1 cm).

At least the distal end 180 of each bristle bundle 172 is configured to engage the floor surface and engage debris on the floor surface to propel the debris toward the brushes of the robot 100 (shown in FIG. 2). In this regard, referring briefly back to FIG. 2, at least a portion of each of the bristle bundles 172 is positionable beyond the front surface 114 and the lateral side 112*a* of the robot 100.

Figure 6D:
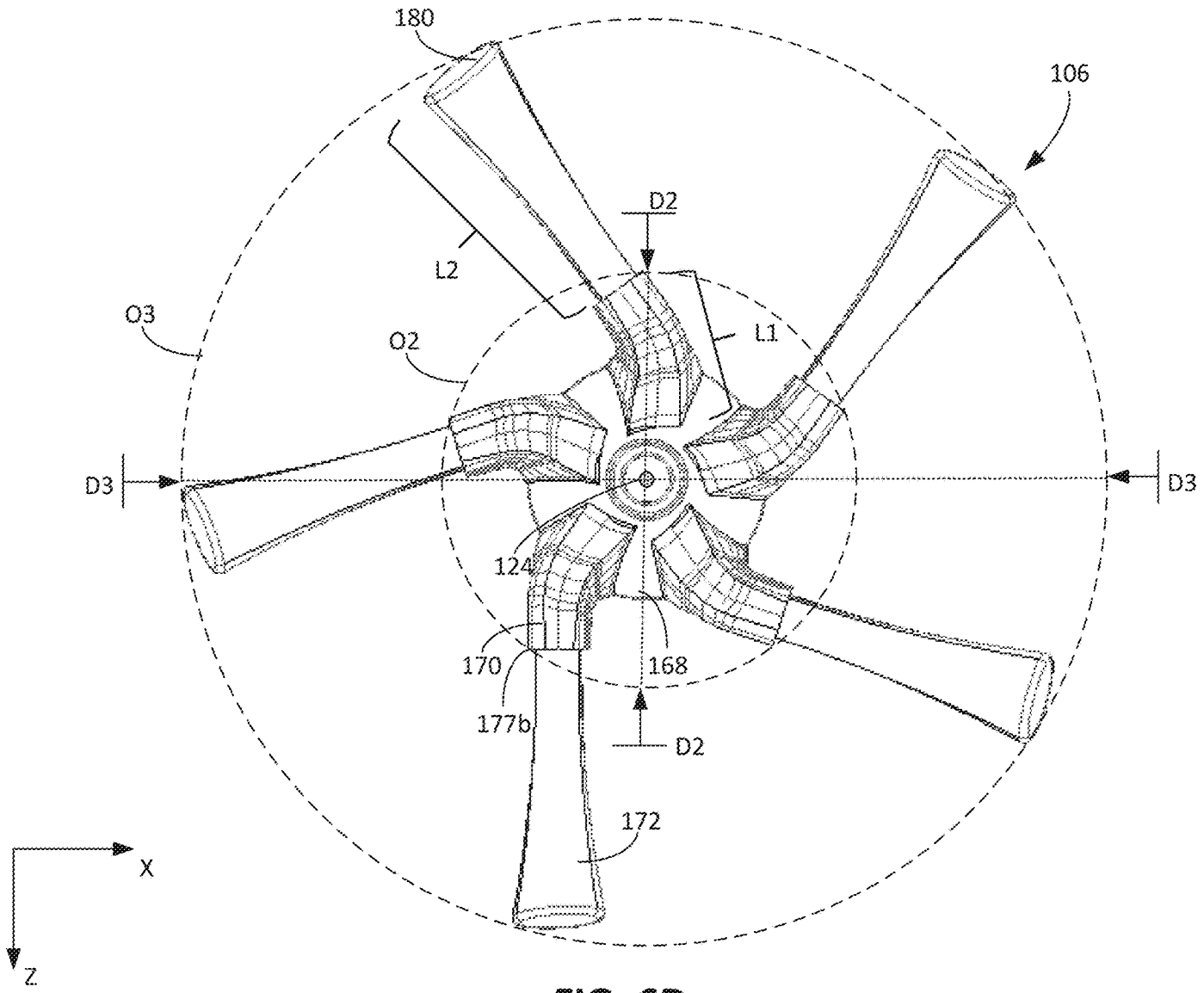

Referring to FIG. 6D, the distal end 180 of each bristle bundle 172 is swept through a circle O3, which corresponds to a circle swept by the distal end 180 of each bristle bundle 172 when viewed along the Y-axis. The circle O3 is defined by a diameter D3. In some cases, if the side brush 106 is mounted such that its axis of rotation 124 is parallel to the vertical axis, the diameter D3 is equal to the width W3 (shown in FIG. 3). Alternatively, if the side brush 106 is mounted at an angle relative to the vertical axis, the diameter D3 may differ from the width W3. In this regard, the diameter D3 is between, for example, 2 cm and 10 cm (e.g., between 2 cm and 6 cm, between 6 cm and 10 cm, between 7 cm and 9 cm, or about 8 cm). In some cases, the diameter D1 (shown in FIG. 6E) is between 10% and 40% of the diameter D3 (e.g., between 10% and 30%, 15% and 35%, 20% and 40%, or about 25% of the diameter D3.). In some cases, the diameter D2 is between 20% and 50% of the diameter D3 (e.g., between 20% and 40%, 25% and 45%, or 30% and 40% of the diameter D3.).

In some cases, the bristle bundles 172 are attached to the arms 170, the hub 168, or both. For example, a proximal end (not shown) of the bristle bundles 172 is attached to the arms 170 or the hub 168. Alternatively or additionally, the bristle bundles 172 extend through the arms 170 and are attached to the arms 170 along the length or a portion of the length of the arms 170.

Figure 7A:
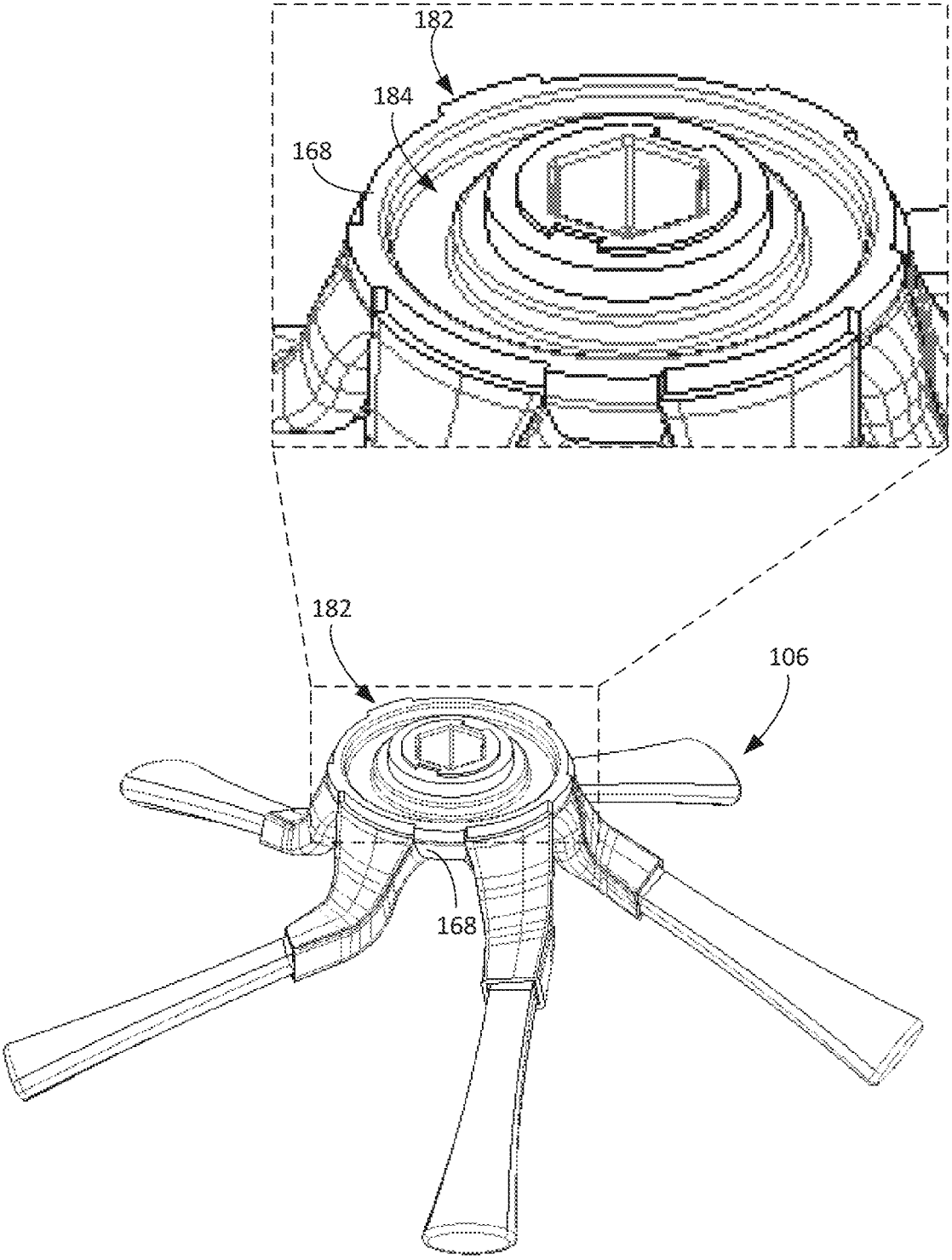
FIGS. 7A and 7B are, respectively, top perspective and top views of the side brush of FIGS. 6A-6E accompanied by insets showing zoomed-in views of a top portion of a hub of the side brush.

Referring to FIG. 7A, a top portion 182 of the hub 168 is configured to collect filament debris engaged by the side brush 106. During an autonomous cleaning operation, filament debris, including hair, threads, carpet fibers, etc., can wrap around the side brush 106 during rotation of the side brush 106. The filament debris, if wrapped around the arms 170 or the bristle bundles 172, can impede operations of the side brush 106. The filament debris can also impede operations of the side brush motor if the filament debris is wrapped around the drive shaft of the side brush motor. The top portion 182 of the hub 168 is configured such that the filament debris is collected in a region away from the arms 170 and the bristle bundles 172.

Figure 7B:
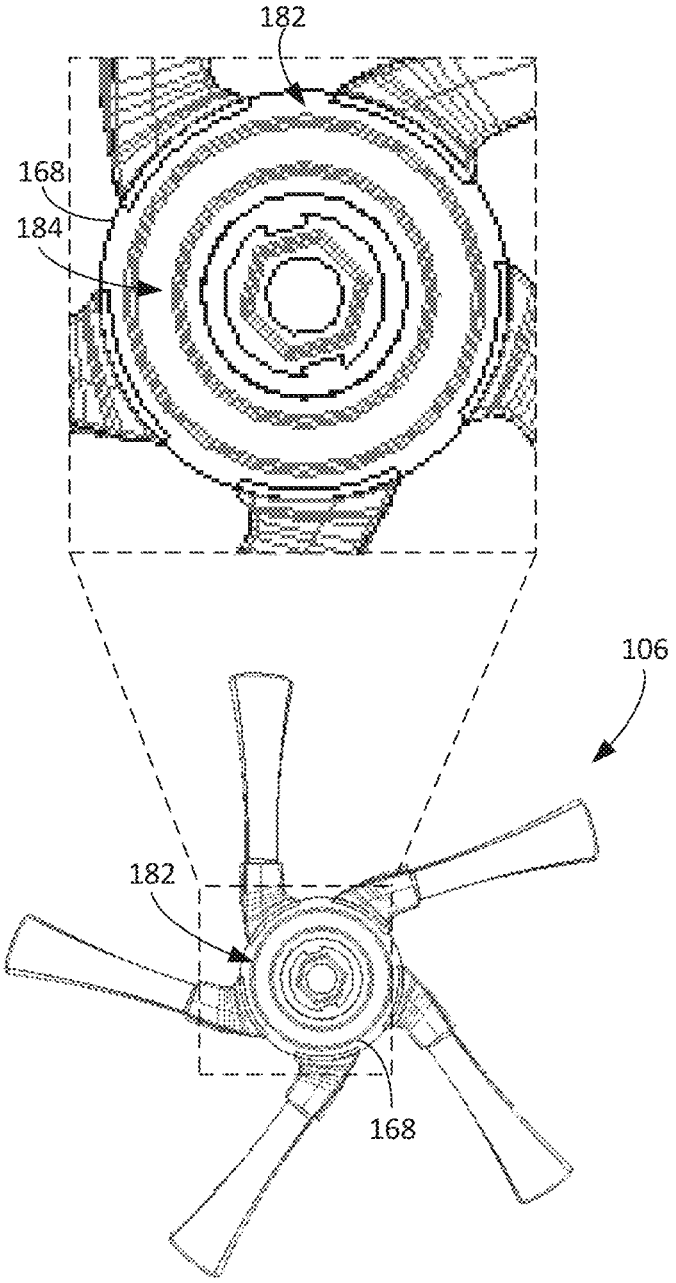
Figure 7C:
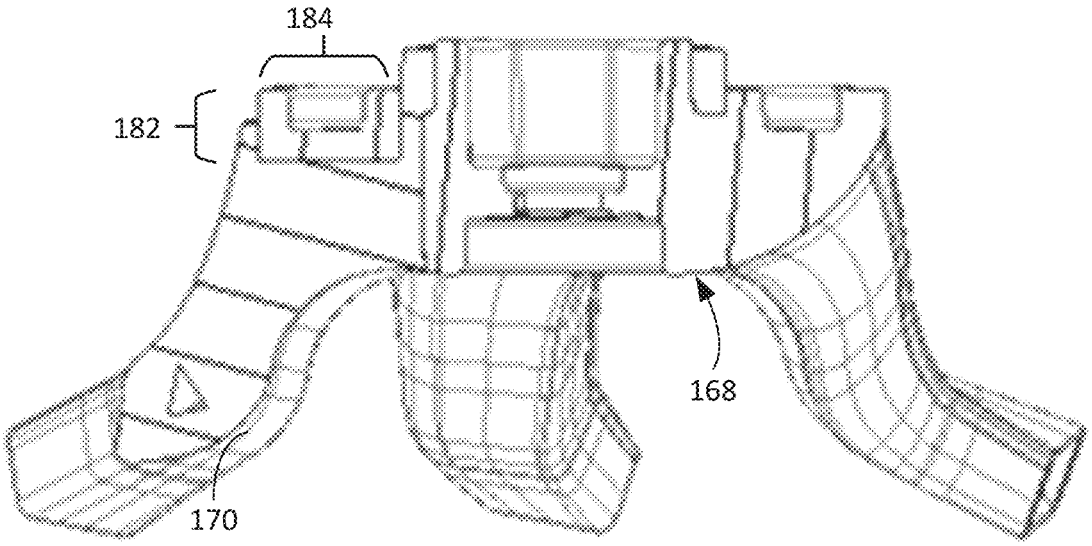
FIG. 7C is a cross-sectional side view of a hub and arms of the side brush of FIGS. 6A-6E.
Figure 8:
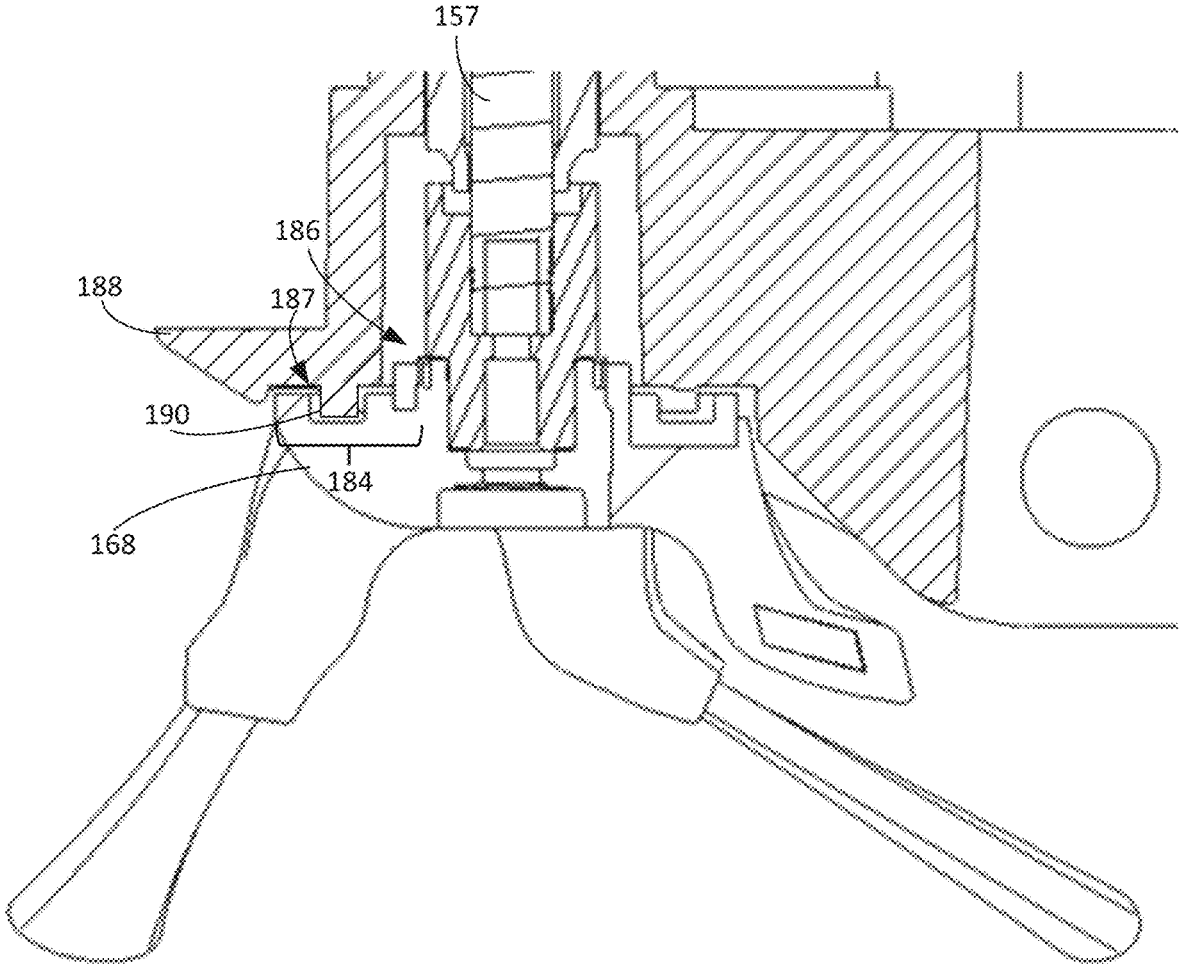
FIG. 8 is a cross-sectional side view of a side brush engaged to a drive shaft of a robot.

As shown in FIGS. 7A-7C, the top portion 182 of the hub 168 includes an inset portion 184 to collect filament debris engaged by the side brush 106. Due to the angles of the arms 170 and the bristle bundles 172 relative to the axis of rotation 124 (shown in FIG. 6A), the filament debris tends to gather toward the top portion 182 of the hub 168. Referring also to FIGS. 4 and 8, the cleaning head module 154 includes an opening 186 that is also configured to collect the filament debris. The drive shaft 157 extends through the opening 186. In this regard, the side brush 106 is mounted at the opening 186 to the drive shaft 157.

As shown in FIG. 8, the inset portion 184 of the hub 168 is positioned to receive the filament debris, and the opening 186 is positioned to receive the filament debris from the inset portion 184. The inset portion 184 and an inset portion 187 along the housing 188 define a region where the filament debris is collected. The housing 188 can be a housing of the cleaning head module 154 or a housing of the robot 100. Barriers 190 circumferentially arranged about the opening 186 extend through the inset portion 187 to inhibit the filament debris from moving beyond the region defined by the inset portion 184 and the inset portion 187. If the filament debris moves beyond this region, the filament debris is collected in the opening 186. For example, the filament debris is collected around the drive shaft 157.

To remove the filament debris collected by the side brush 106, the side brush 106 is dismounted from the drive shaft 157. The filament debris tends to collects outside of the opening 186 due to the barriers 190, thereby making the process of removing the filament debris easier. For example, the region defined by the inset portion 184 and the inset portion 187 is easily manually accessible once the side brush 106 is dismounted. The user can dismount the side brush 106 and manually remove the filament debris from the region.

Other Implementations

A number of implementations have been described. Nevertheless, it will be understood that various modifications may be made.

For example, while the side brush 106 is described as extending beyond the forward surface 114 and the lateral side 112*a* of the robot 100, in some implementations, the side brush 106 extends beyond only the forward surface 114 of the robot 100 or only the lateral side 112*a* of the robot 100.

The hub 168 of the side brush 106 is shown in FIG. 2 as being positioned forward of the brushes 120*a*, 120*b*. For example, the hub 168 is forward of both of the axes of rotation 144*a*, 144*b*. In some implementations, the hub 168 is positioned horizontally adjacent to the brushes 120*a*, 120*b*. In some implementations, the side brush 106 is positioned rearward of the brushes 120*a*, 120*b*, e.g., such that the hub 168 is mounted rearward of the brushes 120*a*, 120*b*.

As depicted in FIG. 2, the axis of rotation 124 is substantially perpendicular to the floor surface (e.g., the axis of rotation 124 is substantially vertical). For example, the axis of rotation 124 and the floor surface form an angle between 85 degrees and 90 degrees. Alternatively, in some implementations, the axis of rotation 124 is at a non-zero angle relative to a vertical axis. For example, the axis of rotation 124 and the floor surface form an angle less than 85 degrees (e.g., between 60 and 85 degrees, 70 and 80 degrees, about 75 degrees, etc.). In this regard, the axis of rotation 124 and a vertical axis form an angle greater than 5 degrees (e.g., between 5 and 30 degrees, 10 and 20 degrees, about 15 degrees, etc.)

In some implementations, the brushes 120*a*, 120*b* include rollers having outer surfaces that engage and brush debris on the floor surface. The outer surface can be, for example, cylindrical. In some cases, the brushes 120*a*, 120*b* include bristles to engage and brush debris.

While the side brush 106 and the brushes 120*a*, 120*b* are described as being driven by multiple motors, in some implementations, the side brush 106 and the brushes 120*a*, 120*b* are driven by a single motor. The robot 100 includes a drivetrain to transfer torque from the motor to each of the brushes 106, 120*a*, 120*b*. Alternatively, the robot 100 includes three distinct motors, each configured to drive a corresponding one of the brushes 106, 120*a*, 120*b*.

While the robot 100 is depicted in FIG. 3 as including two brushes 120*a*, 120*b*, in some implementations, a robot includes a single brush rotatable about an axis parallel to the floor surface. The single brush directs debris on the floor surface toward a bin of the robot. Furthermore, while the brushes 120*a*, 120*b* are depicted as having equal widths W2, in some implementations, one of the brushes is longer than the other of the brushes. For example, one brush has a width that is 70% to 90% of the width of the other brush.

While the robot 100 is depicted in FIG. 3 as including a single side brush 106, in some implementations, the robot 100 includes multiple side brushes. For example, one of the side brushes is located proximate the lateral side 112*a*, while the other of the side brushes is located proximate the lateral side 112*b*. In some implementations, if the robot 100 includes multiple side brushes, either of the lateral sides 112*a*, 112*b* is placed adjacent the obstacle during the obstacle following behavior. The robot 100 does not have a dominant obstacle-following side. In this regard, to clean adjacent an obstacle, the robot 100 does not need to be reoriented so that a dominant side of the robot 100 is placed adjacent the obstacle.

While the side brush 106 is shown and described as a corner brush being positioned proximate the right lateral side 112*a* of the robot 100, in some implementations, the corner brush can be positioned instead on the left lateral side 112*b* of the robot 100. The dominant obstacle-following side of the robot 100 can correspond to a left side of the robot 100 rather than a right side of the robot 100.

While the side brush 106 is shown and described as a corner brush being positioned proximate the right lateral side 112*a* of the robot 100, in some implementations, the robot can include two corner brushes with one positioned on the right lateral side and the other on the left lateral side 112*b* of the robot 100.

In some additional examples, the robot 100 can be square in shape and include four corner brushes with one positioned on or near each of the corners. Having four corner brushes would allow the robot 100 to move in the forward or backward direction while still sweeping dirt into the path from beyond the perimeter of the robot 100.

While the arms 170 of FIGS. 6A-6E are described as extending outwardly from the hub 168 away from the axis of rotation 124 of the side brush 106, in some implementations, the arms 170 extend substantially radially outwardly from the hub 168 away from the axis of rotation 124. For example, the arms 170 extend along axes radiating from the axis of rotation 124 along a plane normal to the axis of rotation 124. In some cases, at least the first portion 174 of each arm 170 extends along a radial axis, e.g., downward and along the radial axis. The second portion 176 extends along an axis at a non-zero angle relative to the radial axis, e.g., downward and along the axis.

In the example depicted in FIGS. 6A-6E, the side brush 106 includes five distinct arms 170 and five corresponding distinct bristle bundles 172. However, in other implementations, a side brush can include two, three, four, six, or more distinct arms and distinct bristle bundles. While the depicted example shows a single bristle bundle per arm, in alternative implementations, a side brush can include two or more bristle bundles per arm.

Accordingly, other implementations are within the scope of the claims.

What is claimed is:

1. An autonomous cleaning robot comprising:

a drive configured to move the robot across a floor surface;

a side brush proximate a lateral side of the robot; and a motor configured to rotate the side brush about an axis of rotation, wherein the side brush comprises a hub configured to engage the motor of the robot, a plurality of arms each extending outwardly from the hub away from the axis of rotation and each being angled relative to a plane normal to the axis of rotation of the side brush, each of the arms comprising a first portion extending outwardly from the hub away from the axis of rotation and a second portion extending outwardly from the first portion away from the axis of rotation, an angle between the first portion of each of the arms and the plane being larger than an angle between the second portion of the each of the arms and the plane, wherein the second portion of each of the arms is angled relative to the first portion of each of the arms in a direction opposite a direction of rotation of the side brush, and a plurality of bristle bundles, each of the bristle bundles attached to a respective one of the plurality of arms and extending outwardly from the second portion of the respective one of the plurality of arms.

2. The robot of claim 1, wherein:

the side brush is a corner brush, the robot further comprises a main brush rotatable about an axis parallel to the floor surface, and the side brush is configured such that at least a portion of the bristle bundles of the side brush is positionable below the main brush during a portion of rotation of the side brush.

3. The robot of claim 1, wherein the axis of rotation is substantially perpendicular to the floor surface.

4. The robot of claim 1, wherein the side brush is a corner brush, and the robot further comprises:

a front portion having a substantially rectangular shape, and a main brush disposed along the front portion of the robot, the main brush extending across 60% to 90% of a width of the front portion of the robot.

5. The robot of claim 4, wherein the motor is configured to rotate the side brush such that a distal end of each of the bristle bundles is swept through a circle defined by a diameter between 15% and 35% of the width of the front portion of the robot.

6. The robot of claim 1, further comprising:

a cleaning head module comprising a main brush rotatable about an axis parallel to the floor surface, and the side brush is mounted proximate a corner portion of the cleaning head module.

7. The robot of claim 1, wherein:

the side brush is positioned proximate a corner portion of the robot formed by a front surface of the robot and a lateral side of the robot, and the motor is configured to rotate the side brush such that each of the bristle bundles is positionable beyond the front surface and the lateral side of the robot.

8. The robot of claim 1, wherein a top portion of the hub comprises an inset portion to collect filament debris engaged by the side brush.

9. The robot of claim 8, further comprising a housing, wherein a bottom surface of the housing comprises an inset portion configured to receive the inset portion of the hub, and wherein the hub is configured to collect the filament debris in a region defined by the inset portion of the housing and the inset portion of the hub.

10. The robot of claim 8, further comprising an opening to receive the hub of the side brush, the opening configured to collect filament debris received from the inset portion of the hub.

11. The side brush of claim 1, wherein a top portion of the hub comprises an inset portion to collect filament debris on the floor surface and engaged by the side brush, the inset portion comprising a barrier defining an outer perimeter of the inset portion.

12. The robot of claim 1, wherein a height of the hub is between 0.25 cm and 1.5 cm.

13. The robot of claim 1, wherein the hub is formed from a rigid polymer material having an elastic modulus between 1 and 10 GPa, and the arms are formed from an elastomeric material having an elastic modulus between 0.01 and 0.1 GPa.

14. The robot of claim 1, wherein the angle between the first portion of each of the arms and the plane is between 70 and 90 degrees.

15. The robot of claim 1, wherein the angle between the second portion of each of the arms and the plane is between 15 and 60 degrees.

16. The robot of claim 1, wherein an angle between the first portion of each of the arms and the second portion of each of the arms is between 100 and 160 degrees.

17. The robot of claim 1, wherein an angle between an axis along which the second portion extends and a circle defined by an outer perimeter of the hub is between 30 and 60 degrees.

18. The side brush of claim 11, wherein the barrier is a first circumferential barrier defining the outer perimeter of the inset portion, and the top portion of the hub comprises a second circumferential barrier defining an inner perimeter of the inset portion.

19. The side brush of claim 1, wherein each of the plurality of arms tapers from a proximal end where the first portion attaches to the hub to a distal end out of which a corresponding bristle bundle of the plurality of bristle bundles extends.

20. The side brush of claim 1, wherein the second portion of the plurality of arms extends along an axis that intersects with an outer perimeter of the hub.

21. The side brush of claim 1, wherein the first portion of each of the plurality of arms extends along a plane comprising a radial axis of the side brush.

22. A side brush mountable to an autonomous cleaning robot, the side brush comprising:

a hub configured to engage a motor of the autonomous cleaning robot such that the side brush rotates about an axis of rotation to agitate debris on a floor surface when the motor is driven;

a plurality of arms each extending outwardly from the hub away from the axis of rotation and each being angled relative to a plane normal to the axis of rotation of the side brush, each of the arms comprising a first portion extending outwardly from the hub away from the axis of rotation and a second portion extending outwardly from the first portion away from the axis of rotation, an angle between the first portion of each of the arms and the plane being larger than an angle between the second portion of the each of the arms and the plane, wherein the second portion of each of the arms is angled relative to the first portion of each of the arms in a direction opposite a direction of rotation of the side brush, and a plurality of bristle bundles, each of the bristle bundles attached to a respective one of the plurality of arms and extending outwardly from the second portion of the respective one of the plurality of arms.

23. The side brush of claim 22, wherein a top portion of the hub comprises an inset portion to collect filament debris on the floor surface and engaged by the side brush.

24. The side brush of claim 22, wherein a height of the hub is between 0.25 cm and 1.5 cm.

25. The side brush of claim 22, wherein the hub is formed from a rigid polymer material having an elastic modulus between 1 and 10 GPa, and the arms are formed from an elastomeric material having an elastic modulus between 0.01 and 0.1 GPa.

26. The side brush of claim 22, wherein the angle between the first portion of each of the arms and the plane is between 70 and 90 degrees.

27. The side brush of claim 22, wherein the angle between the second portion of each of the arms and the plane is between 15 and 60 degrees.

28. The side brush of claim 22, wherein an angle between the first portion of each of the arms and the second portion of each of the arms between 100 and 160 degrees.

* * * * *